US007434806B2

(12) United States Patent
Budden

(10) Patent No.: US 7,434,806 B2
(45) Date of Patent: Oct. 14, 2008

(54) CHESS VARIANT AND METHOD OF PLAY THEREOF

(76) Inventor: Michael J. Budden, 1033 Calmar Dr., Jeannette, PA (US) 15644

( * ) Notice: Subject to any disclaimer, the term of this patent is extended or adjusted under 35 U.S.C. 154(b) by 151 days.

(21) Appl. No.: 11/291,561

(22) Filed: Dec. 1, 2005

(65) Prior Publication Data

US 2006/0113728 A1 Jun. 1, 2006

Related U.S. Application Data

(60) Provisional application No. 60/632,282, filed on Dec. 1, 2004.

(51) Int. Cl.
*A63F 3/00* (2006.01)

(52) U.S. Cl. ..... 273/261; 273/255

(58) Field of Classification Search ..... 273/255, 273/260, 261, 262
See application file for complete search history.

(56) References Cited

U.S. PATENT DOCUMENTS

| | | | | |
|---|---|---|---|---|
| 1,441,386 | A * | 1/1923 | Truskoski | 273/282.1 |
| 5,511,793 | A * | 4/1996 | Watt | 273/260 |
| 5,690,334 | A | 11/1997 | Duke | |
| 5,735,523 | A | 4/1998 | Fioriglio | |
| 5,901,957 | A | 5/1999 | Leyva et al. | |
| 5,954,333 | A | 9/1999 | Vilches Guerra | |
| 6,116,602 | A | 9/2000 | McLoy | |
| 6,336,632 | B1 | 1/2002 | London | |
| 6,446,966 | B1 | 9/2002 | Crozier | |
| 6,481,716 | B2 | 11/2002 | Trice | |
| 6,550,770 | B1 | 4/2003 | Rackliff | |
| 6,702,287 | B1 | 3/2004 | Pendexter | |

FOREIGN PATENT DOCUMENTS

| | | | |
|---|---|---|---|
| WO | WO 96/19272 A1 | 6/1996 | |

OTHER PUBLICATIONS

Christian Freeling's Grand Chess, http://www.chessvariants.com/large.dir/freeling.html, Aug. 12, 2004.
Link to: Quantum Chess, http://www.chessvariants.com/d.link/quantum.html, Aug. 11, 2004.
Omega Chess, http://www.play.chessvariants.com/erf/OmegaChs.html, Aug. 11, 2004.

* cited by examiner

*Primary Examiner*—Vishu K. Mendiratta
(74) *Attorney, Agent, or Firm*—The Webb Law Firm

(57) ABSTRACT

A chess variant includes (a) one of an order 8 board, an order 10 board, and an order 12 board; (b) a conventional chess piece set; and (c) a non-convention chess piece set, wherein the pieces of the non-conventional chess piece set perform non-standard movements defined by a combination of movements corresponding to two or more of the conventional chess pieces. The non-conventional chess pieces have rules associated therewith to govern how the pieces enter the board. The non-conventional chess pieces may also have specialized functions including serving as diodes, transportation pieces, and turning movement pieces. A method of playing the chess variant is also disclosed.

2 Claims, 21 Drawing Sheets

| Unit Name | Abbreviation | Movement description | Board/Order Game |
|---|---|---|---|
| Archer | *A* | Prototype | [10S], [12] |
| Bishop | *B* | Prototype | |
| Cardinal | *C* | B+N | |
| Dragon | *D* | R+N+A | [10S], [12] #1 |
| Elephant | *E* | ** Special ** | [10], [10S], [12] |
| Falcon | *F* | K+N | [10], [12] #2 |
| Guard | *G* | Promotable, forward K | |
| Javelin | *J* | ** special directional ** | [10], [10S], [12] #3 |
| Lance | *L* | ** special directional ** | [10], [10S], [12] #3 |
| King | *K* | Prototype | |
| Minister | *M* | R+N | |
| Knight | *N* | Prototype | |
| Pawn | *P* | Promotable | |
| Queen | *Q* | R+B | |
| Rook | *R* | Prototype | |
| Trebucket | *T* | N+A | [10S], [12] |
| Duchess | *U* | R+A | [10S], [12] |
| Wizard | *W* | K+B+A | [10S], [12] |
| Archbishop | *X* | K+B | [10], [10S], [12] |
| Yeoman | *Y* | Promotable | [10S], [12] |
| Angel | @ | B+R+N or Q+N | #4 |

#1 This piece can also make a special parachute move; it can be placed on any vacant square adjacent to a friendly unit, on or before the parachute move limit. Initially off board.
#2 This piece can also make a special parachute move; it can be placed on any vacant square adjacent to a friendly unit, on or before the parachute move limit. Initially on board.
#3 These pieces are highly directional and have limited range. Initially off board.
#4 This piece can also make a special parachute move; it can be placed on any vacant square, on or before the parachute move limit. Initially off board. Note the @ does not have to be placed next to a friendly unit as does the D!

FIG. 3

(A) Before King-Side Castling
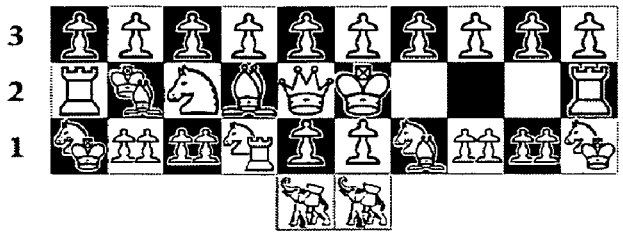
(B) After King-Side Castling
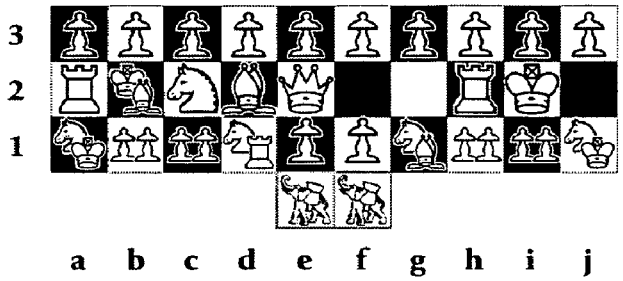
FIG. 31
(A) Before Queen-Side Castling
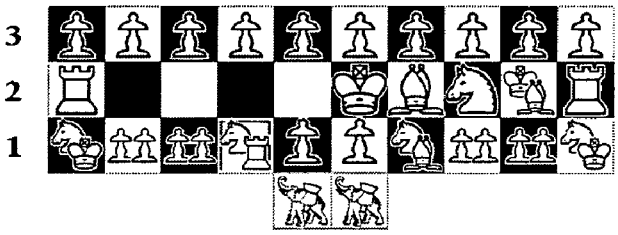
(B) After Queen-Side Castling
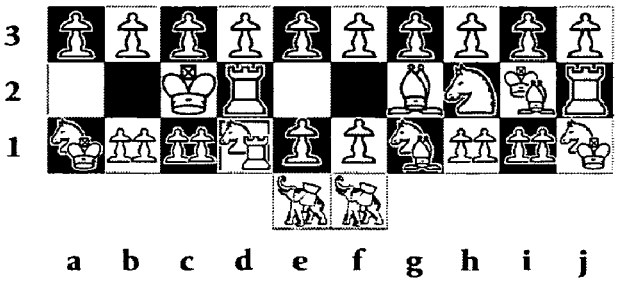
FIG. 32

(A) Before King-Side Castling
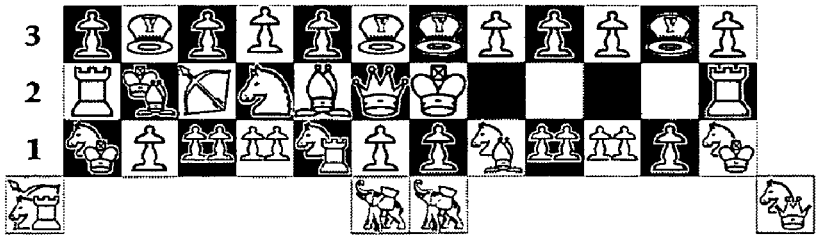
(B) After King-Side Castling
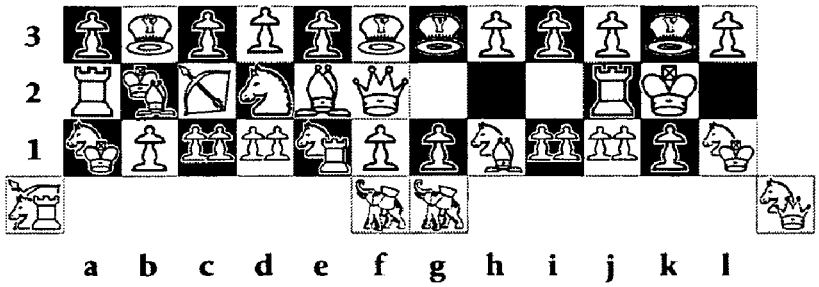
FIG. 33
(A) Before Queen-Side Castling
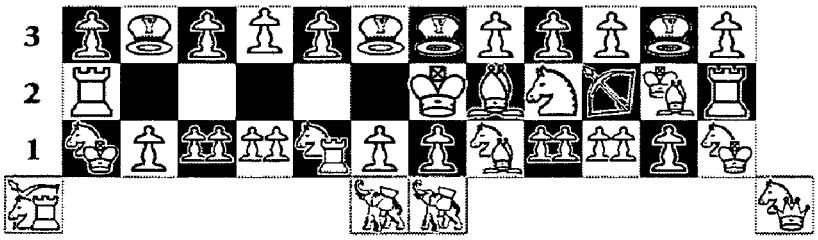
(B) After Queen-Side Castling
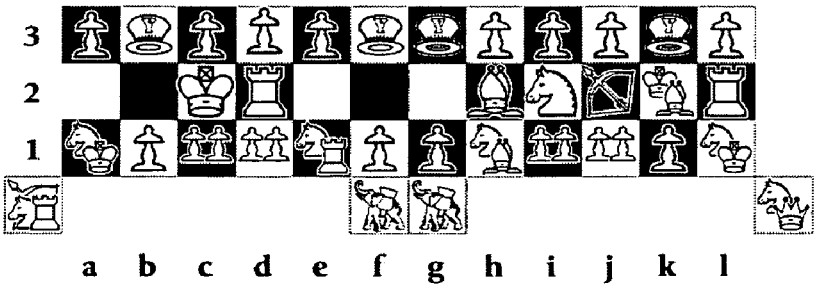
FIG. 34

(A) Before King-Side Castling
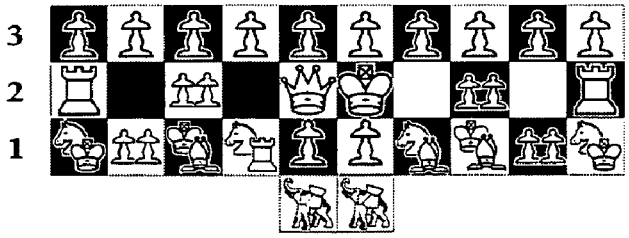
(B) After King-Side Castling
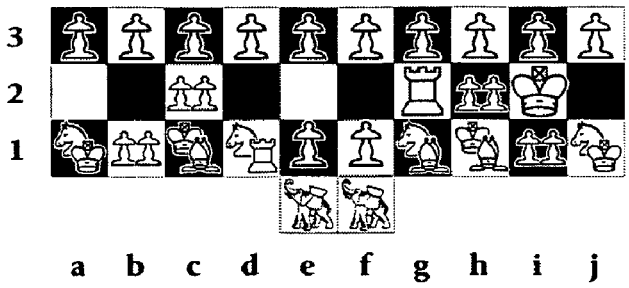
FIG. 35
(A) Before King-Side Castling
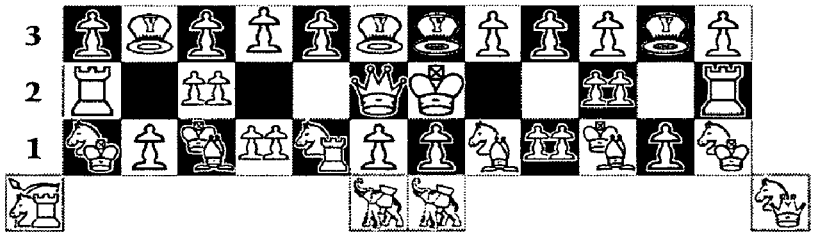
(B) After King-Side Castling
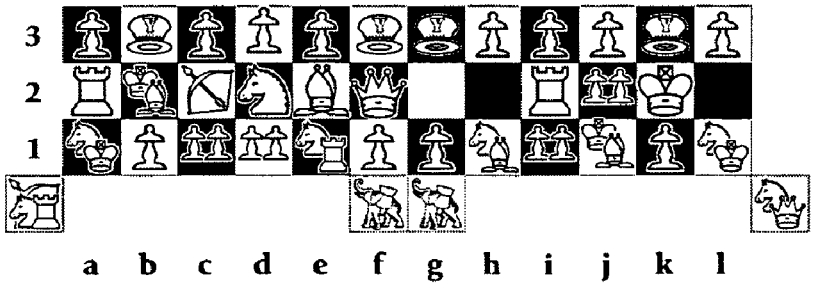
FIG. 36

(A) Before King and Queen-Side Canterbury
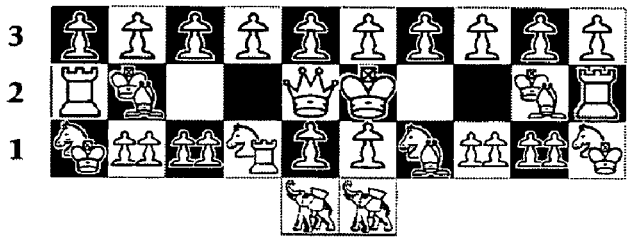
(B) After King and Queen-Side Canterbury
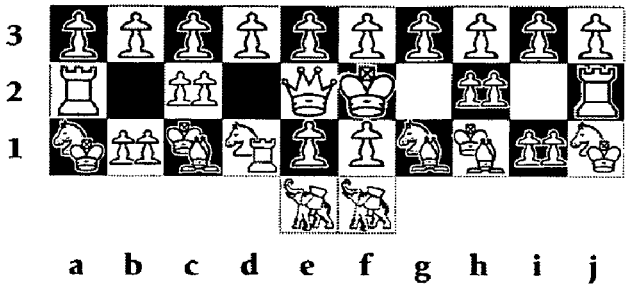
FIG. 37
(A) Before King and Queen-Side Canterbury
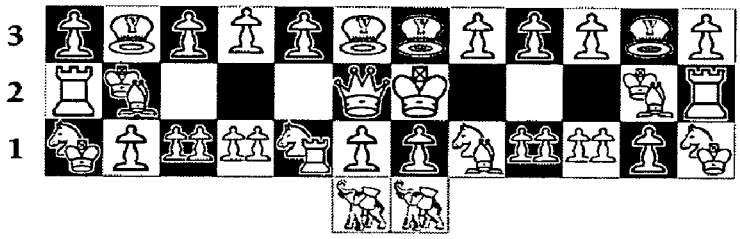
(B) After King and Queen-Side Canterbury
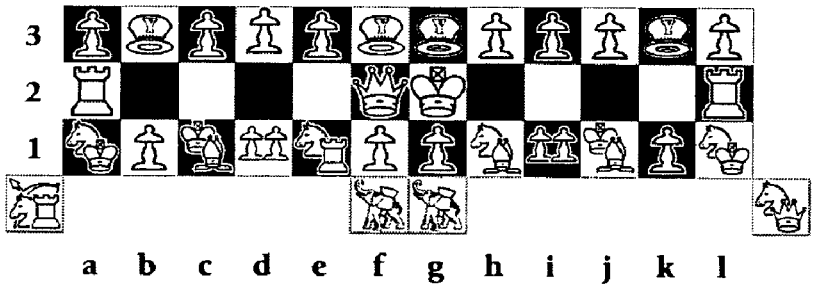
FIG. 38

CHESS VARIANT AND METHOD OF PLAY THEREOF

CROSS REFERENCE TO RELATED APPLICATIONS

This application claims the benefit of U.S. Provisional Patent Application No. 60/632,282, filed Dec. 1, 2004, and entitled "Method of Playing a Variant of Chess", the contents of which are incorporated herein by reference.

BACKGROUND OF THE INVENTION

1. Field of the Invention

The present invention relates to chess games and, more specifically, to a chess variant and method of play thereof.

2. Description of Related Art

The game of chess is well-known, dating back hundreds or even thousands of years by most accounts. Conventional chess is a two-player game played on a chessboard having sixty-four alternating black and white squares comprising eight horizontal rows, and eight vertical columns. In conventional chess, each player begins the game with sixteen movable game pieces as follows: one King, one Queen, two Rooks, two Bishops, two Knights and eight Pawns. The object of conventional chess is to "checkmate" the opposing player's King. Each player's pieces are initially positioned in a predetermined opposed, mirrored relation to his opponent's pieces. The players alternate turns by moving any one of their pieces to a different square on the chess board according to predefined movement rules. A player captures his opponent's pieces during a turn by moving his piece into a square occupied by one of the opponent's pieces. The rules associated with conventional chess are well known and are generally outlined in U.S. Pat. No. 5,735,523 to Fioriglio and U.S. Pat. No. 5,690,334 to Duke, which are hereby incorporated in their entirety by reference.

By rule, each game piece in classic chess has limitations placed upon its movement. For example, the King generally may move one square in any available direction (e.g. horizontally, vertically, or diagonally). The Queen may move through any number of unobstructed squares in any straight line (e.g. horizontally, vertically or diagonally). The Queen may not jump other pieces. The Rook may move through any number of unobstructed squares in a straight line, either horizontally or vertically. The Rook may not jump other pieces. The Bishop may move through any number of unobstructed squares in any straight diagonal line. The Bishop may not jump other pieces. The Knight makes a move which consists of a first one-square step in either a horizontal or a vertical direction, and a second one-square step diagonally. The Knight may jump other pieces. With the following two exceptions, the Pawn may only move forward one square. First, on its initial move, the Pawn may move forward one or two squares. Second, the Pawn captures other pieces by moving one square diagonally.

It should be noted that in conventional chess, other variant moves are permitted under limited circumstances, such as "castling" moves and "en passant" capture moves. Castling involves the simultaneous movement of the King and the Rook. Several castling moves are known. For example, in one castling move the King moves horizontally along a row two squares inward toward the Rook, and the Rook moves horizontally over and beyond the King to the next adjacent square in that row. An "en passant" capture is a move executed by the Pawn in which the Pawn attacks an opposing Pawn, the opposing Pawn having just been advanced two squares from its original square in one move. In such circumstances, the attacking Pawn may move diagonally one square into the square passed over by the opposing Pawn and capture the Pawn.

In addition to classical chess, many alternative versions of chess have developed throughout the years. For example, U.S. Pat. No. 6,702,287 to Pendexter and U.S. Pat. No. 6,481,716 to Trice disclose exemplary variations on conventional chess. However, these prior art chess variants require a non-standard sized chess board to accommodate new pieces. Thus, a player is required to carry the non-standard sized chess board to the locale at which he wishes play. Furthermore, non-movable chess boards, such as chess boards integrated into a decorative game table or granite park table, are unable to support chess variants requiring non-standard sized chess boards. Thus, it is desirable to provide a chess variant that may utilize traditionally-sized chessboards, while maintaining exciting and effective playability.

Although non-standard sized boards offer enhanced playability, the games pieces and set of rules for a particularly sized board are applicable only to that board and may not be ported to boards of other sizes or configurations. Thus, once a player becomes familiar with the underlying rules of the chess variant corresponding to a particular sized board, the rules knowledge and game-play knowledge acquired by playing that chess variant is inapplicable to other chess variants. Frustratingly, this requires the player to learn new rules and strategies for other chess variants, as opposed to building upon his existing knowledge. Thus, it is desirable to provide a chess variant that maintains a similar underlying set of rules and game pieces that may be applied to both a traditional chess board as well as various non-standard sized boards.

Additionally, a need exists to minimize the complexity and learning curve of the chess variant that is sought to be played, thereby increasing the appeal of the chess variant to a wide player demographic. Furthermore, although prior art chess variants are playable, they may not necessarily be played intelligently, as the players are not aware of the value and strength of each new piece in relation to the non-standard board size or configuration. Thus, prior art chess variants are not fully developed to encompass higher levels of game-play.

As shown, a need exists for a new and improved chess variant that is a logical extension of ordinary or conventional chess but utilizes new pieces in conjunction with standard or non-standard sized chess boards to provide new challenges to conventional opening moves, capture strategies, promotions, etc.

SUMMARY OF THE INVENTION

The present invention will now be described with reference to the accompanying figures and drawings, however, is the exemplary embodiments discussed herein are not to be construed as limiting the invention.

The present invention introduces a new approach to ordinary or conventional chess gaming by implementing, generally, new units or pieces and the corresponding movement, capture strategies, and promotions associated therewith. This new approach encompasses the following exemplary and non-limiting elements of the present invention.

New Stalemate Rule: ½ Point Win:

An object of the present invention is to checkmate one's opponent's King (K). Perpetual checks and three move repetition are traditionally ½-½ draws. However, according to the present invention, it is not recommended that stalemate be treated as a ½ point win, ¾ for the stronger side, and ¼ for the side whose K cannot move. Thus, there may be two types of wins, 1-0 (full point) or ¾-¼ (half point), which will cut down on the number of draws. When one player resigns, that player can resign a full point or a half point. His opponent does not have to accept a ½ point resignation if he thinks that by playing on he can squeeze a full point out of the position. Therefore many K+P vs. K endgames become ½ point wins for the stronger side. This takes nothing away from the skill in these endings because either side may misplay and lose the full or half point. Furthermore, many insufficient mating force endings like K+B vs. K now become ½ point wins.

Definitions of Pieces and Promotables and Promotion Rank:

As in conventional chess, one makes the distinction between units that are pieces and units that are non-pieces. In conventional chess, Pawns are the only non-pieces. A Pawn can promote to any piece upon reaching the last rank. In the present invention, there are three non-pieces, namely, the Pawn (P), the Guard (G), and the Yeoman (Y), and they too can promote upon reaching the last rank (i.e., Promotion Rank) to any piece except an Angel (@) or a Dragon (D). This arrangement therefore still allows for an occasional reason for underpromotion. The aforementioned three units (P, G, or Y) may be referred to as promotables when one wants to distinguish them from other pieces like the P in conventional chess. The promotables can only move forward and they cannot change their facing direction.

Directional Pieces, Range, and Definition of Board Directions:

The present invention makes some use of new principles like direction and range. Directional pieces have a movement stencil that is not symmetric, but is rather biased in the direction they are facing (e.g., the J, the L, and the E, and on Order 10 and 12 boards, the Knight (N) and the Archer (A)). These pieces can be turned to face any direction the player chooses, but turning a piece constitutes a move. Directional pieces cannot turn facing direction and change square locations on the same move. The facing directions are the four compass directions printed on the boards, namely, north, south, east, and west. White sits at the south end of the board and Black at the north end of the board. Just as each square has a unique location based on its rank and file, each piece has a unique facing direction which must be indicated when recording games.

Additionally, some non jumping pieces such as the J and the L have a "range." Unlike a Bishop (B) or a Rook (R), they cannot move an unlimited number of vacant squares. The J and the L, worth 2.5 and 3.25 Pawns respectively on a 10×10 board, were invented to provide pieces that are weaker than a B or a N (worth 4 P on a 10×10 board). It is unlikely that during an exchange sequence one could get four Pawns for a B or N in the present invention, but rather two or three P, as in conventional chess, are quite possible. Also, the Y and G are worth more than a P. Thus, the present invention maintains the piece vs. pawn (promotable) imbalance as in conventional chess.

Board Entry for Off-board Pieces:

In the present invention, some pieces start off the board. Generally, most of the "off board" pieces must be brought onto the board at precise square locations and facing directions (e.g., the J, L, and E, etc.). When bringing a piece onto the board, the entry square must be vacant with the exception of the Elephant. Board entry moves are never capturing moves, and they cannot be used to block a check except the parachute move. However, board entry moves may give check. Bringing a piece onto the board is considered a move. The piece entering the board cannot move to another square or change its facing direction until the player's next turn. A piece that has just entered the board can be immediately captured by an enemy unit. Pieces brought onto the board cannot be removed from the board except by capture. Thus, they can never go back to their off board locations. For the White Angel (@) and Duchess (U), the board entry square is the southeast corner and for Black the northeast corner. For the White Wizard (W) and Dragon (D), the board entry square is the southwest corner and for Black the northwest corner. Some pieces have multiple board entry squares in the beginning phase of the game, as is described hereinafter. The @ can be brought onto either corner square in the 8×8 embodiment of the present invention.

Parachute or Bughouse Movement and Limits (Optional):

This rule can be considered optional. It provides more complexity and makes startling sacrificial attacks in the opening more likely and dangerous. It partially compensates for the extra defense around the King on the higher order boards (e.g., 10×10 and 12×12). However, the present invention is playable without it. It is not intended that parachute movement be used on an 8×8 board as it is too advantageous for White. However, on the higher order boards, it appears to not provide any unfair advantage.

On the Order 10 and 12 boards the @ may make a board entry move to any vacant square on or before move "n" where n is the board order number, for example, 10 or 12. This move is called a parachute move and is similar to the popular chess variant known as bughouse, except it is limited to the first n moves of a game. The D may move to any vacant square adjacent to a friendly unit on or before move "n." Both the @ and the D may be used for parachute movement in the same game. These are the only units that have the parachute property but for the Delayed Promotion with the Yeoman. It is to be understood that both White and Black may make use of this move. Note, that an @ or D may parachute in and give check, and that a @ or D may parachute in to block check. This is the only case when a board entry move may be used to get out of check. If the move limit for parachute movement has been exceeded, then the board entry rules for the @ and D revert to the corner squares.

Inactive Units:

Some units start on the board, but are inactive or "upside down". These units cannot move or capture until they are first activated or "turned over". Activating a unit (i.e., turning it right side up) is considered a complete move. Thus, one cannot activate a unit and then change its square location on the same turn. The exception to this rule is the special Canterbury move. Inactive units may be captured by enemy units. Inactive units act as blockades to friendly units in that friendly units may not occupy the same square as an inactive unit. Inactive units are utilized because play testing revealed that the defense was too strong, in that everything was covered double, sometimes triple, and initial sacrificial attacks were much more difficult than in conventional chess.

Elephants (Optional):

This rule can be considered optional. The E (for use with Order 10 and 12 boards) is a completely new piece with very unusual movement rules. Generally, the E is a directional transportation piece, i.e., it can "carry" up to 4 promotables (P, G, or Y). However, it moves and captures very slowly, like a K, and only in a forward direction. Like any directional piece it can change its facing direction. The E cannot be captured by any promotable. The E is completely immune to capture from the front, except by another E. It can, however, be captured by any piece from the side or rear. The definition of front, side, or rear depends on the E facing direction. In a special move called a "stampede," the E can move two squares straight forward, and can capture up to two enemy units on a single turn. Its primary use is to bust open a fortress K position.

Combination Pieces and Prototypes:

In conventional chess, there are four prototype or basic pieces: the King, Knight, Rook, and Bishop. The Queen is a combination piece because it can move like a Rook or a Bishop, so it is like the combination of the two. In the present invention, there are 5 prototypes, the K, N, R, B as in ordinary chess, and the new prototype, the Archer (A). There are also many new combination pieces based on the 5 prototypes. For example, the Cardinal (C) is a combination of the E and the B, whereas the Minister (M) is a combination of the R and the N. The movement stencil of combination pieces is always the sum (mathematically the union) of each prototype piece of which it is a combination. It is important to preserve the relative value of B and E as about equal on all boards. This means that on Order 10 and 12 boards, where the Bishop's unlimited range give it even more scope than in ordinary chess, the Knight's move needs to be augmented. Specifically, this would be two squares on a 10×10 board and four squares on a 12×12 board. Move augmentation is necessary for the A also. Thus. the final movement stencil of a piece is the sum of a unit's prototype movement and any augmentation due to board size. Combination pieces, however, always have a movement stencil that is the sum of the prototype units only. Thus, the M moves the same on all boards, in that it does not receive any of the augmented moves of the N on higher order boards.

Capturing Restrictions on Promotables Behind the Pawn Start Rank:

In the present invention, some promotables start behind the Pawn Start Rank (PSR). Play testing revealed that these were effective defensive units, so much so that they ruined many sacrificial attacks that occur in ordinary chess. To address this imbalance, the rule is established that promotables have no offensive worth. In other words, they cannot capture, until they attain the PSR.

Initial Move Bonus for Promotables (P, G, and Y):

In conventional chess, Pawns can move one or two squares on their first move from the PSR. However, in the present invention, any promotable, (P, G, or Y) may make use of the initial move bonus moving from the PSR. For example, in the 12×12 game and in the 10×10 scalable game, promotables may move one, two, or three squares on their initial move. Note, however, this bonus move is not a capturing move.

Accordingly, the present invention includes a method of playing a variant chess game by a first player against a second player, including the steps of (a) providing a game board comprised of at least eight horizontal rows and at least eight vertical columns of squares having alternating light and dark squares forming a checkerboard pattern; (b) providing a first set and a second set of conventional pieces for the first and second player, respectively, wherein each set of conventional pieces includes one King, one Queen, a first and second Rook, a first and second Bishop, a first and second Knight, and eight Pawns; (c) positioning the first and second set of conventional pieces on the squares of the board in spaced-apart mirrored relation with respect to each other; and (d) providing a first set and a second set of non-conventional pieces for the first and second player, respectively, wherein each set of non-conventional pieces includes at least: an Angel, wherein movement associated therewith corresponds to movement associated with the Queen and the Knight; a Cardinal, wherein movement associated therewith corresponds to movement associated with the Bishop and the Knight; a Minister, wherein movement associated therewith corresponds to movement associated with the Rook and the Knight; and a first and second Guard.

Further steps of the present invention include (a) positioning the Angel off the board; (b) positioning the first Guard off the board and adjacent to a square occupied by the King of the first player; (c) positioning the second Guard off the board and adjacent to a square occupied by the Queen of the first player; (d) positioning the Cardinal off the board and adjacent to a square occupied by the first Bishop of the first player; and (e) positioning the Minister off the board and adjacent to a square occupied by the second Bishop of the first player. Additional steps include (a) moving the Angel to the square occupied by the first or second Rook in the initial placement thereof; (b) moving the first and second Guard to the square occupied by the King and Queen, respectively, in the initial placement thereof; (c) moving the Cardinal to the square occupied by the first Bishop in the initial placement thereof; and (d) moving the Minister to the square occupied by the second Bishop in the initial placement thereof.

Further steps of the present invention include (a) moving one of the conventional or non-conventional pieces of the first player through a square occupied by one of the Guards of the first player; and (b) preventing movement of one of the conventional or non-conventional pieces of the second player through a square occupied by one of the Guards of the first player. The Guards may be promotable and may capture in a forward moving direction.

The game board may include at least ten horizontal rows and at least ten vertical columns of squares having alternating light and dark squares forming a checkerboard pattern. Thus, the game board may include twelve horizontal rows and twelve vertical rows.

Each set of non-conventional pieces further includes an Archer having a movement defined as: three squares forward and one square sideways; two squares forward and two squares sideways; one square forward and three squares sideways; three squares backward and one square sideways; two squares backward and two squares sideways; and one square backward and three squares sideways.

Each set of non-conventional pieces further includes a Trebucket, wherein movement associated therewith corresponds to movement associated with the Archer and the Knight; a Duchess, wherein movement associated therewith corresponds to movement associated with the Archer and the Rook; a Wizard, wherein movement associated therewith corresponds to movement associated with the Archer, Bishop, and the King; and a Dragon, wherein movement associated therewith corresponds to movement associated with the Archer, Rook, and the Knight.

Each set of non-conventional pieces further includes a Yeoman, wherein movement associated therewith corresponds to the Pawn with the exception of: optionally moving two squares forward when not capturing; moving forward one square if the square in front of the Yeoman is vacant, and thereafter capturing in a diagonally forward movement; and performing delayed underpromotion.

Each set of non-conventional pieces further includes an Elephant, wherein movement associated with the Elephant is turning, forward, and diagonal, and wherein the Elephant can carry a Pawn, Guard, or Yeoman.

Each set of non-conventional pieces further includes an Archbishop, wherein movement associated therewith corresponds to movement associated with the Bishop and the King, and wherein the Archbishop is stacked on a same square with the Archer.

A chess game includes (a) a game board comprised of at least eight horizontal rows and at least eight vertical columns of squares having alternating light and dark squares forming a checkerboard pattern, and (b) a first set and a second set of conventional pieces, wherein each set of conventional pieces includes one King, one Queen, a first and second Rook, a first and second Bishop, a first and second Knight, and eight Pawns, wherein the first and second set are positioned on the squares of the board in spaced-apart mirrored relation with respect to each other. An improvement to such an existing chess game may include a first set and a second set of non-conventional pieces, wherein each set of non-conventional pieces includes: an Angel designated piece positioned off the board; a first Guard designated piece positioned off the board and adjacent to a square occupied by the King of the first set of conventional pieces; a second Guard designated piece positioned off the board and adjacent to a square occupied by the Queen of the first set of conventional pieces; a Cardinal designated piece positioned off the board and adjacent to a square occupied by the first Bishop of the first set of conventional pieces; and a Minister designated piece positioned off the board and adjacent to a square occupied by the second Bishop of the first set of conventional pieces. 14. The Angel designated piece includes visual indicia representative of a Queen and a Knight; the Cardinal designated piece includes visual indicia representative of a Bishop and a Knight; and the Minister designated piece includes visual indicia representative of a Rook and a Knight.

Alternatively, the chess game of the present invention may include a game board comprised of at least ten horizontal rows and at least ten vertical columns of squares having alternating light and dark squares forming a checkerboard pattern; a first set and a second set of conventional pieces, wherein each set of conventional pieces includes one King, one Queen, a first and second Rook, a first and second Bishop, a first and second Knight, and eight Pawns; and a first set and a second set of non-conventional pieces, wherein each set of non-conventional pieces includes: an Angel designated piece having visual indicia representative of a Queen and a Knight; a Cardinal designated piece having visual indicia representative of a Bishop and a Knight; a Minister designated piece having visual indicia representative of a Rook and a Knight; an Archbishop designated piece having visual indicia representative of a Bishop and a King; and a Falcon designated having visual indicia representative of a King and a Knight.

The first and second set of conventional pieces and the first and second set of non-conventional pieces may be tiles. The tiles corresponding to the Angel, Cardinal, Minister, Archbishop, and Falcon are of a first geometric shape, whereas other tiles are of a second geometric shape different from the first geometric shape.

These and other advantages of the present invention will be understood from the description of the preferred embodiments, taken with the accompanying drawings.

BRIEF DESCRIPTION OF THE DRAWINGS

FIG. 3 is a table of abbreviations, move descriptions, and board/order game applicability associated with each of the conventional and non-conventional units depicted in FIGS. 1 and 2;

FIG. 31 is a schematic diagram illustrating the placement of the conventional and non-conventional units prior to and after a King-side castling on the Order 10 board;

FIG. 32 is a schematic diagram illustrating the placement of the conventional and non-conventional units prior to and after a Queen-side castling on the Order 10 board;

FIG. 33 is a schematic diagram illustrating the placement of the conventional and non-conventional units prior to and after a King-side castling on the Order 12 board;

FIG. 34 is a schematic diagram illustrating the placement of the conventional and non-conventional units prior to and after a Queen-side castling on the Order 12 board;

FIG. 35 is a schematic diagram illustrating the placement of the conventional and non-conventional units prior to and after a King-side castling through a Guard on the Order 10 board;

FIG. 36 is a schematic diagram illustrating the placement of the conventional and non-conventional units prior to and after a King-side castling through a Guard on the Order 12 board;

FIG. 37 is a schematic diagram illustrating the placement of the conventional and non-conventional units prior to and after a King and Queen-side Canterbury on the Order 10 board; and FIG. 38 is a schematic diagram illustrating the placement of the conventional and non-conventional units prior to and after a King and Queen-side Canterbury on the Order 12 board.

DETAILED DESCRIPTION OF THE INVENTION

Figure 1:
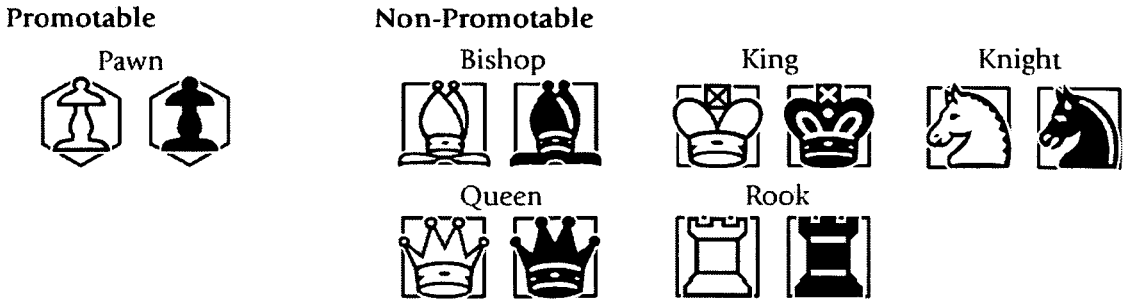
FIG. 1 is a schematic diagram of conventional chess units in accordance with the present invention.

For purposes of the description hereinafter, spatial or directional terms shall relate to the invention as it is oriented in the drawing figures. However, it is to be understood that the invention may assume various alternative variations, except where expressly specified to the contrary. It is also to be understood that the specific invention illustrated in the attached drawings, and described in the following specification, are simply exemplary embodiments of the invention. Hence, specific dimensions and other physical characteristics related to the embodiments disclosed herein are not to be considered as limiting.

Figure 2:
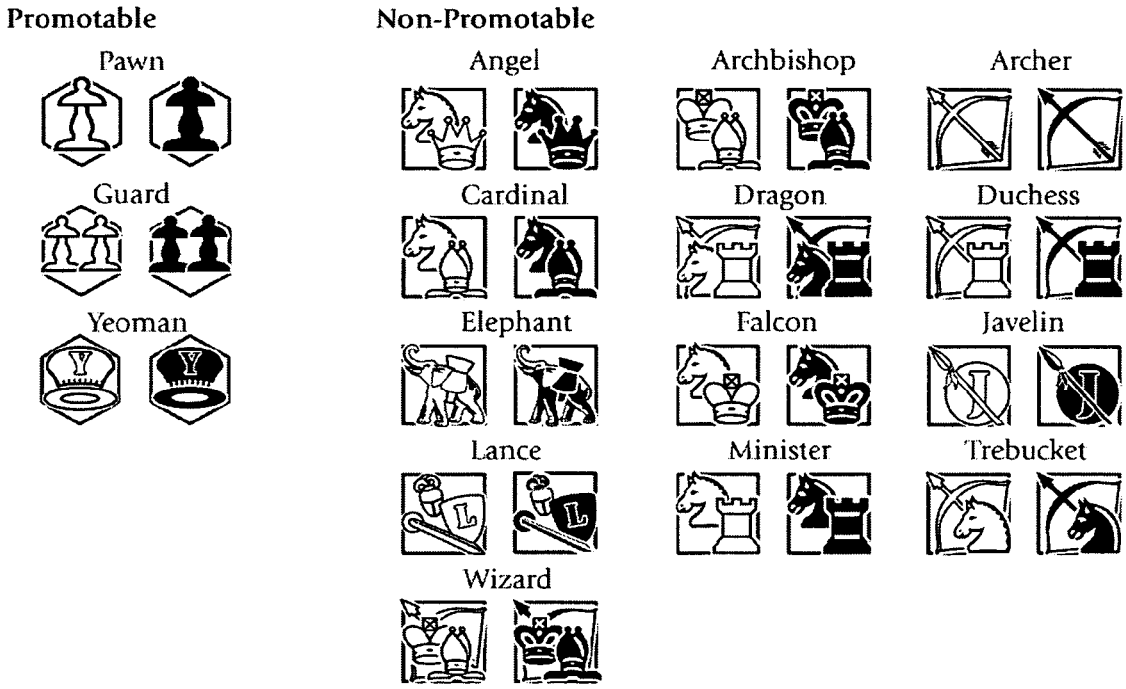
FIG. 2 is a schematic diagram of non-conventional chess units in accordance with the present invention.

The present invention modifies and builds upon the rules and units associated with conventional chess. It is to be understood that the rules of conventional chess apply to this invention except where otherwise noted. The desirable embodiment of the present invention includes chess piece representations silk screened onto ceramic mosaic tiles. FIGS. 1 and 2 depict an exemplary set of chess units. Specifically, FIG. 1 depicts traditional or conventional chess piece representations, such as pawns, bishops, kings, knights, queens, and rooks, whereas FIG. 2 depicts non-conventional chess piece representations. The non-conventional chess piece representations include, but are not limited to guards, yeomans, angels, archbishops, archers, cardinals, dragons, duchesses, elephants, falcons, javelins, lances, ministers, trebuckets, and wizards. It is to be understood that the naming conventions of the game units are for exemplary purposes only and may be altered without affecting the function or scope of such game units. The non-conventional chess piece representations have unique movement and capture rules associated with them that will be discussed in greater detail herein. The conventional and non-conventional chess piece representations may be divided into promotable and non-promotable units, as designated by square-shaped and hex-shaped tiles, respectively. Furthermore, the non-conventional chess piece representations may be depicted as combination chess units, such that graphical representation thereon are indicative of movements associated with two or more conventional units. However, it is to be understood that different indicia may be utilized for various identification purposes associated with the conventional and/or non-conventional chess piece representations. This may include, but is not limited to diagrams (painted, etched, raised, etc.), lettering, or other suitable indicia.

The fact that the units are embodied as tiles allows the units to be stacked, such that more than one unit may occupy a square. For efficient manufacturing and distribution purposes, the tiles may be connected to each other by a glue bead on the back, such that the tiles may be separated by twisting back and forth until the bead breaks. The present invention may utilize conventional pre-existing three-dimensional chess units in conjunction with the tiles representing the non-conventional chess units. Thus, it is to be understood that there are no limitations with respect to the specific embodiments of chess units that are to be utilized in connection with the present invention.

The present invention may utilize Order 8, Order 10, and Order 12 chess boards. It is to be understood that the present invention may therefore utilize pre-existing Order 8 chess boards. However, desirably, the present invention includes prefabricated Order 10 and Order 12 boards for use specifically with the present invention. Desirably, the Order 10 and Order 12 boards are embodied on opposite sides of a roll-up sheet, such as a vinyl sheet. The vinyl sheet may be designed to easily uncurl and remain relatively flat. Each of the boards may be coded in algebraic notation for recording moves. A tubular container may be provided for storage purposes so that the vinyl sheet may be rolled up and inserted therein. Thereafter, the units may be placed into the tubular container and the container may be sealed.

The present invention may be understood by the following terms, as defined herein. In the desirable embodiment, the board is to be oriented such that White is at the south end of the board and Black is at the north. There should be a white square in the right hand corner. The following definitions are used throughout the specification. Rank: A row of squares running east-west; ranks are designated by numbers, 1-10 for a 10×10 board, 1-12 for a 12×12 board; File: A column of squares running north-south; files are designated by the letters a-j for a 10×10 board, a-l for a 12×12 board; First Rank: For White the rank with the lowest number; for Black the rank with the highest number; Last Rank: For White the rank with the highest number; for Black the rank with the lowest number (also referred to as the Promotion Rank); Pawn Start Rank (PSR): The rank where most of the pawns (and Yeomen, if playing with Yeomen) initially start (For White, rank two on an 8×8 board, and the 10×10 scalable game, rank three on the 10×10 and 12×12 boards); Direction: Some pieces have preferential movement in the direction they are "facing" (Pieces can face any one of the four compass directions: north, south, east, or west. All White pieces begin facing north; all Black pieces begin facing south. White and Black off board pieces must face north, and south respectively when initially brought onto the board); and Development: The process of bringing one's pieces off their initial squares and out into the "middle" of the board where they can better participate in attack and defense.

The table depicted in FIG. 3 outlines the unit names, abbreviations, move descriptions, and board/order game applicability associated with each of the units. All units in the present invention may have a single capital letter as a character symbol or abbreviation that will be used hereinafter for ease of reference to the respective units. These abbreviations may be used in the recording of moves. For the ordinary chess units, the character in the present invention, e.g. the Rook represented as "R", may be used. Under "Movement Description" the entry "Prototype" indicates that the movement type is basic and that some combination pieces are "built" from this piece. The square brackets indicate which board size or game the piece plays on; no entry under "Board Order" indicates that the unit plays on all order boards. Thus, the Bishop and the Angel may be used on all boards, while the Archbishop is used on the 10×10, the 10×10 scalable, and the 12×12 board. The Archer is used only on the 10×10 scalable board and the 12×12 board.

Visual Symbols:

The visual symbols used in the present invention playing pieces are the usual symbols seen in chess publications. However there are many new units in the present invention, so a list of unit names and graphical representations are provided herewith, as generally shown in FIGS. 1 and 2. Combination pieces like the Minister, Cardinal, and Trebucket have the symbol of both prototype pieces on the playing tile to help in memorization and to facilitate play.

Figure 4:
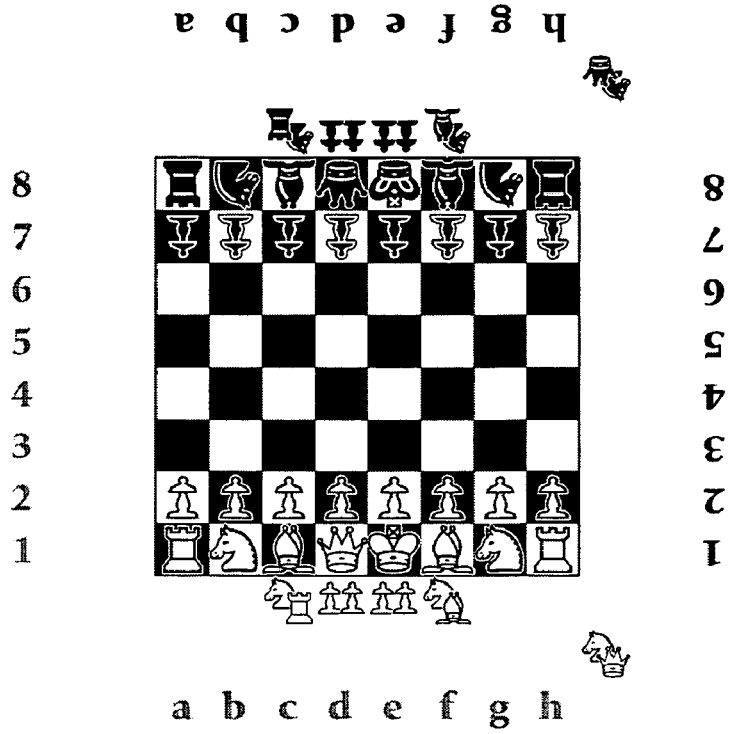
FIG. 4 is a schematic diagram of an Order 8 chess board depicting placement of the conventional and non-conventional units thereon in accordance with the present invention.
Figure 5:
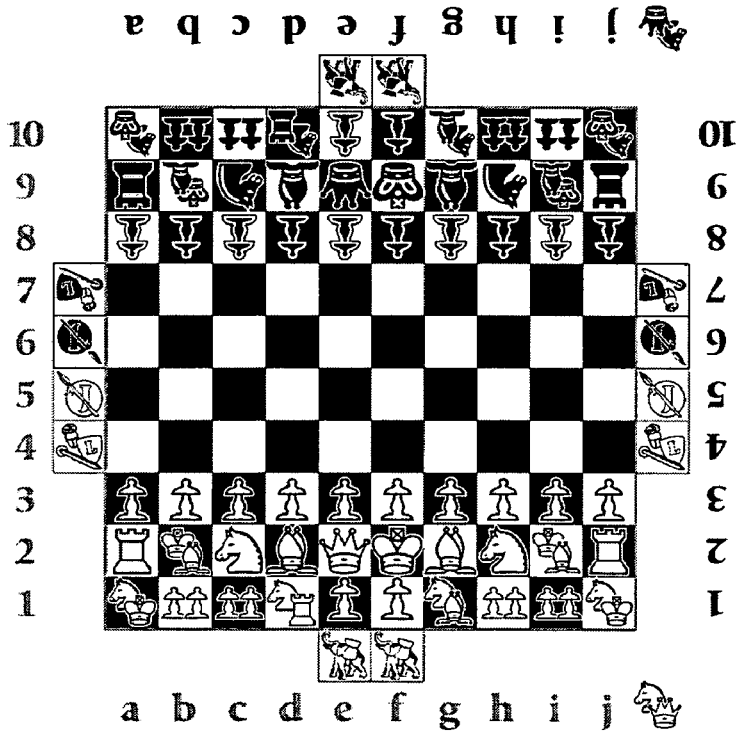
FIG. 5 is a schematic diagram of an Order 10 chess board depicting placement of the conventional and non-conventional units thereon in accordance with the present invention.
Figure 6:
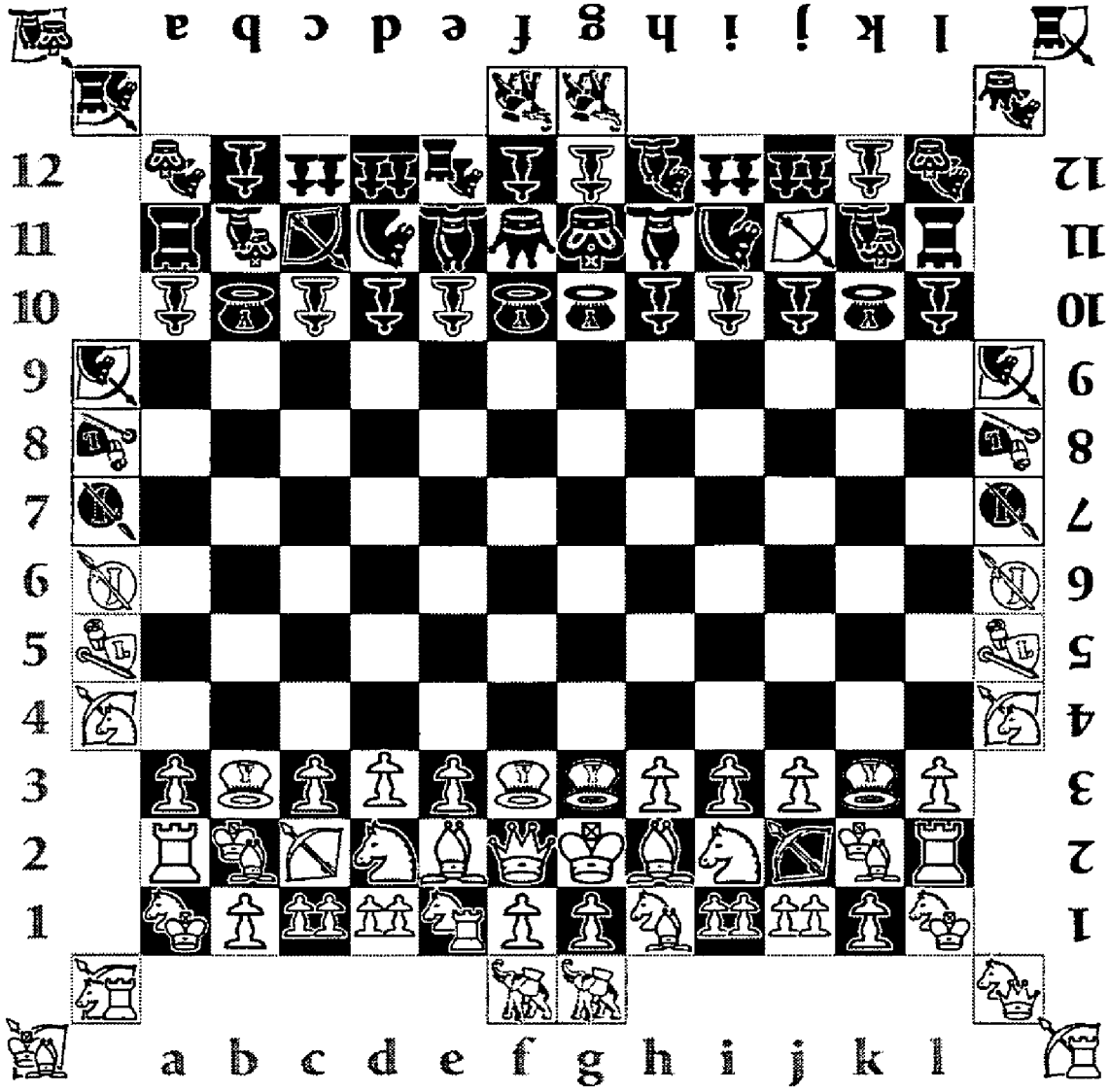
FIG. 6 is a schematic diagram of an Order 12 chess board depicting placement of the conventional and non-conventional units thereon in accordance with the present invention.
Figure 7:
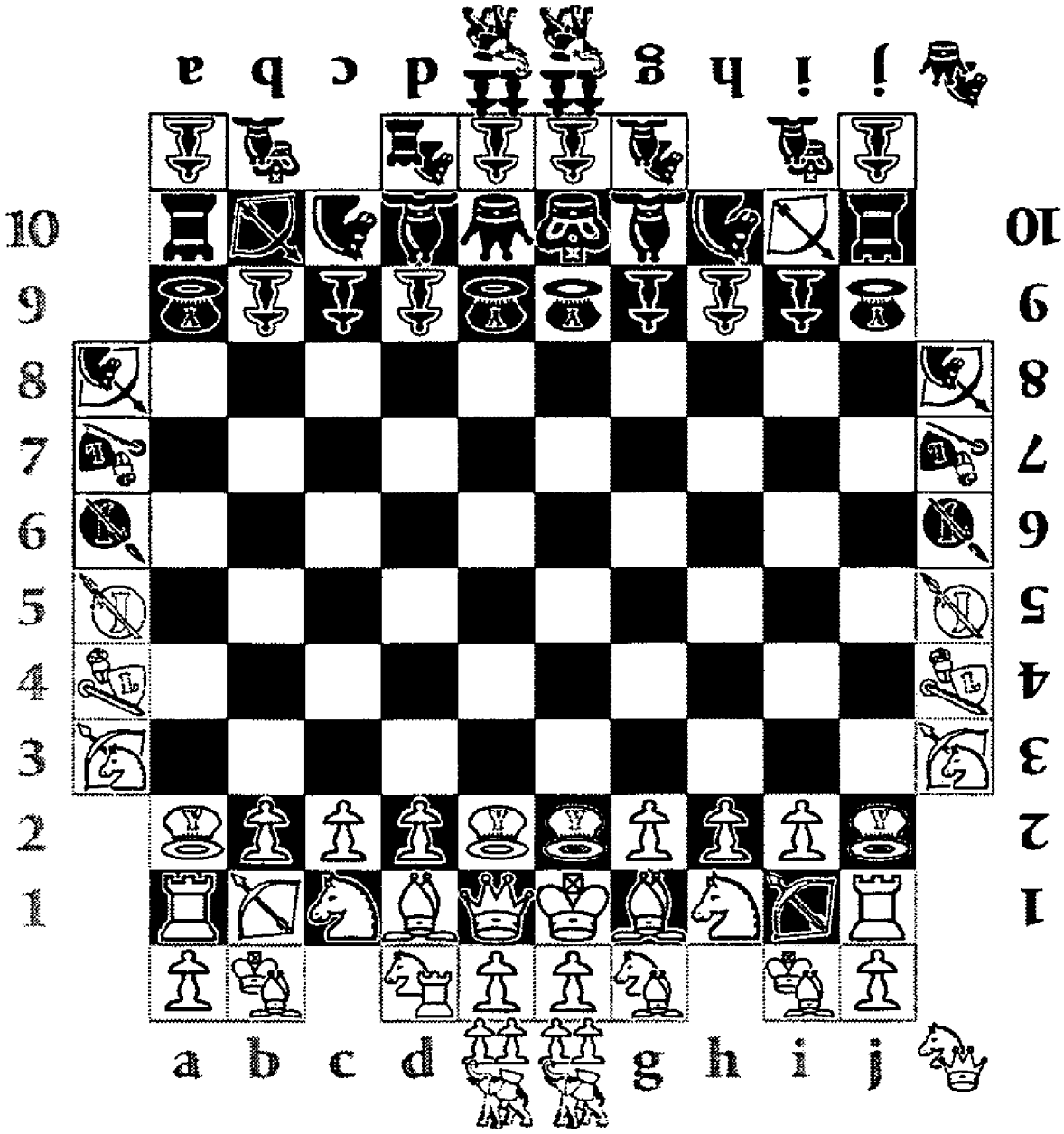
FIG. 7 is a schematic diagram of an Order 10 scalable chess board depicting placement of the conventional and non-conventional units thereon in accordance with the present invention.
Figure 8:
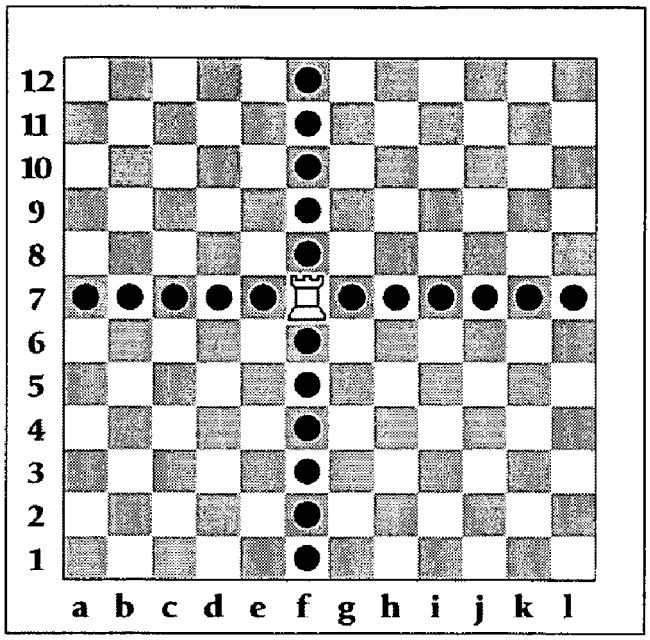
FIG. 8 is a schematic diagram illustrating the movement of a Rook.
Figure 9:
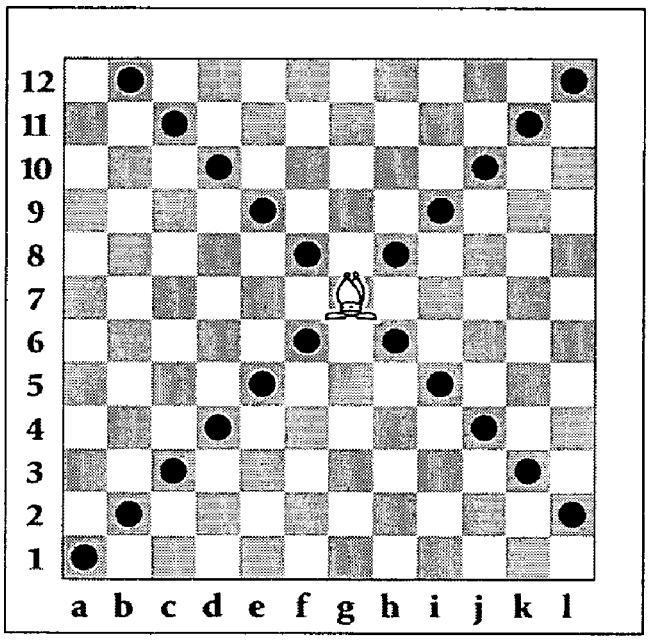
FIG. 9 is a schematic diagram illustrating the movement of a Bishop.
Figure 10:
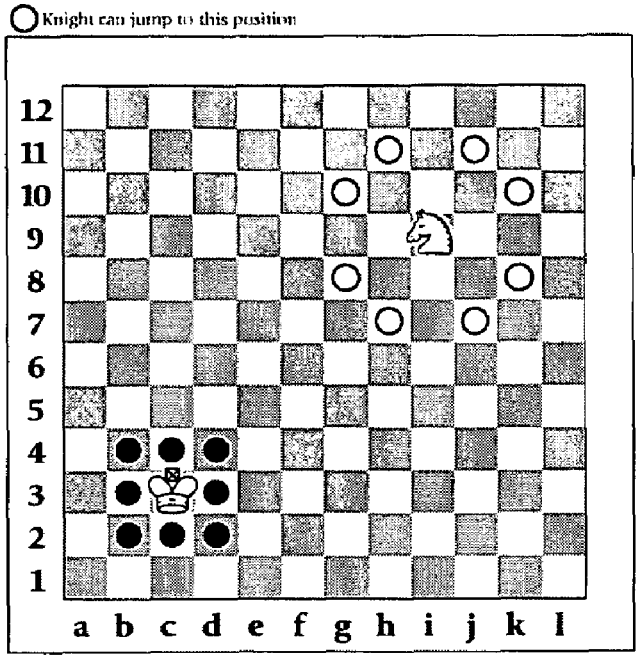
FIG. 10 is a schematic diagram illustrating the movement of a King and a Knight.

Initial Unit Placement:

FIGS. 4, 5, and 6 show the initial setup for the games played on Order 8, 10, and 12 boards, respectively. FIG. 7 shows the initial set up for the 10×10 scalable game. Note, that the units that are circled are initially inactive (e.g., placed upside down) and must first be activated by turning them over before they can be moved. For the Order 10×10 game, White inactive units are at: a1, b1, c1, and i1, j1, k1. The Black inactive units are on the same files, but the Black first rank. For the Order 12 game, the White inactive units are at: a1, b1, c1, d1, and i1, j1, k1, l1, and similarly for Black. The activation of each unit constitutes a move, except for the special Canterbury move, which will be discussed hereinafter. In all of the setups, there should be a white square in the right hand corner, with White at the south end of the board and Black at the north. The 10×10 scalable game has some different features than the three other games described herein. Standardized algebraic chess notation, as is known in the art, is used in the discussion of movement of units.

Weak Squares in the Initial Placement:

As in ordinary chess the weakest square in the Black camp is the square immediately in front of his King's Bishop, (f7 on an 8×8 board, g8 on the 10×10 board, g9 in the 10×10 scalable game, and h10 on the Order 12 board). Sacrifices on this square are very dangerous because recapture can only be done by the K, which then loses the Castling and Canterbury privileges. This may in turn result in the K becoming exposed to attack. The parachute rules make these sacrifices even more dangerous. On the other hand, defensive resources in the present invention are greater: activated Guards can provide a lot of cover filling up holes, and the C, M, and F (except in the 10×10 scalable game) provide further support to the crucial squares around the K and the pawns in front of the K. In ordinary chess the only undefended unit at the start is the R, whereas in the present invention every unit is defended, the R by the X for example. Note that the Rook pawns are defended by both the R and the X. Also, the 10×10 scalable game differs substantially in this area.

Archers and Yeomen Interlocking Defense:

Archers, and the related combination pieces are an addition to the 12×12 game and the 10×10 scalable game. They present special problems. Jumping pieces like the A or the N are dangerous because they cannot be "blocked" like other pieces. However the N has a range of only two squares, so that for a N to attack an enemy piece on the back rank, with a wall of pawns in front of the back rank, the N would be immediately subject to attack by one of the Pawns, unless there was a "hole". For example, on an 8×8 board, a White N could attack a Black R at h8 by sitting on g6. However if Black has not created a hole at g6, either a pawn at f7 or h7 could capture the White N at g6.

Archers, however, with a range of three squares could stand off in complete immunity from a pawn wall and still attack the back rank, full of pieces more valuable than an A. For example on a 12×12 board, White could play his A from j2 to i5 on his first move, and on his next move deliver a wicked check by moving to h8, completely immune from the pawn wall on the rank ten. This would make the Archers too strong and lead to the quick forced gain of material by the first player. Studying the rules for A movement in conjunction with Y capture, and the initial placement of the pieces, not only is every square in front of the PSR guarded, but every square two ranks in front of the PSR is guarded by the interlocking pattern of Y's and A's. For example on a 12×12 board, every square on rank nine is guarded either by a Black P, Y, or a Black piece. But notice that every square on rank eight is guarded by either a Black Y or A. The same is true for White, and also in the 10×10 scalable game. One is advised to be careful, because once one moves a Y (to facilitate development and control the center) or develop an A, holes for enemy Archers are also created.

Immediate Attack on the Central Squares:

In ordinary chess, games often begin with these moves: e4 e5 and then Nf3 Nc6. On the first move, White moves a center P to control the center, and prepare for development of a B. Black counters by moving one of his central Pawns for the same reason. Then, on the second move, White immediately sets the stage by attacking the Black P, and Black responds by defending it. This immediate "central crisis" is what makes open games, and their natural excitement possible. In the present invention, in the 12×12 game and the 10×10 scalable game, where the P or Y can move up to three squares on the first turn, the Knights are too far away to immediately attack the P or Y on a central square. However because the A has a longer range, and is still close to the center in the initial setup, an immediate central crisis can be created in the present invention. For example, in the 12×12 game: Yg6, Yg7 and then Ai5, Ae9. On the second move White attacks the Black Y on g7 with his A on i5, development with attack. Black responds with Ae9, development with defense. Note that Black cannot play the second move Ad8?, because he must also stop a third move Ah8+, a nasty check that would cost Black the castling privilege. The 10×10 scalable game has a similar placement of the Yeomans and Archers for the same reason. Other chess variants played on larger boards have ruined the central crisis.

How the Units Move

Normal Movement Stencil for the Units:

FIGS. 8 to 30 show the movement/capture stencil of each unit in the present invention. FIGS. 8-11 show the movement of the five prototype pieces: Rook, Bishop, King, Knight, and Archer. The first four prototypes are familiar to every player of ordinary chess; the present invention adds a fifth prototype, the Archer. Most of the other pieces are made of combinations of these fundamental movement types. A completely new piece, the Elephant, has been added, which is not a combination piece. The E is a very complicated piece and play with the E is optional.

In the figures, the "symbol" indicates the square the unit is on; a "black circle" is a square the unit can move to or capture on by "sliding", and a "white circle" indicates that a unit can go to that square by jumping. A "gray circle" on a square (e.g. FIG. 12) means that a unit can only go to that square if it is a capturing move. Just like ordinary chess, capturing is by displacement, not by jumping as in checkers. When one moves a unit to a square occupied by an enemy unit, ones "captures" that unit and removes it from the board. As in ordinary chess, the K can never be captured.

In ordinary chess, the P is different from any of the pieces. In the present invention there are Pawns (P) and two other units, the Yeoman (Y) and the Guard (G) that are like the Pawns in ordinary chess. Note that the P, Y, and G only move forward, never backward or sideways, and they cannot change their facing direction (only pieces can change their facing direction). The P and Y move differently when they capture, and all three of these units are called "promotables" because when they reach the last rank they can promote or be turned into any piece (except an Angel or a Dragon). Finally, all three of these units get a special move bonus coming off of the Pawn Start Rank (PSR). Depending on the game, promotables can move one, two, or three squares on their first move. The principle is the same as in ordinary chess, they can move to the furthest rank on their side of the board when leaving the PSR. It is important to understand the special capture movement of the Y, when the square directly in front of a Y is vacant.

Some pieces are directional pieces, that is, they move differently depending on which direction (north, south, east, or west) they are facing. On Order 10 and 12 boards, the directional pieces are: E, A, J, L, and N. Note that the A and N are "slightly" directional, while the E, J, and L are "highly" directional. The E may not move backwards or sideways. Directional pieces, not promotables, can change their facing direction. Changing the direction of a piece constitutes a move; a piece cannot change both its facing direction and its square location on a single turn.

Figure 25:
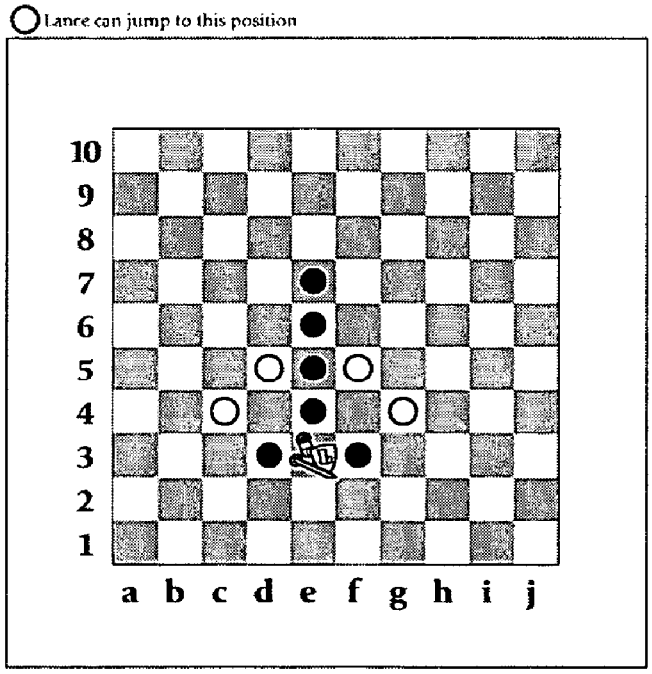
FIG. 25 is a schematic diagram illustrating the movement of a Lance with respect to the Order 10 board.
Figure 26:
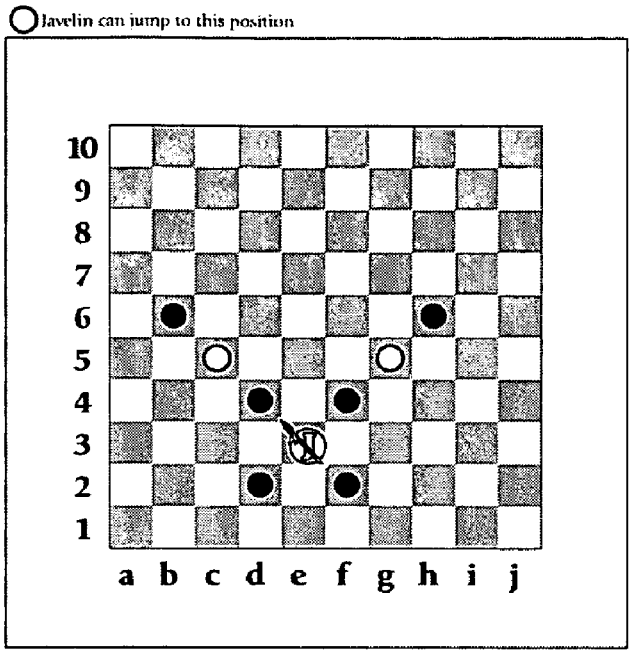
FIG. 26 is a schematic diagram illustrating the movement of a Javelin with respect to the Order 12 board.
Figure 27:
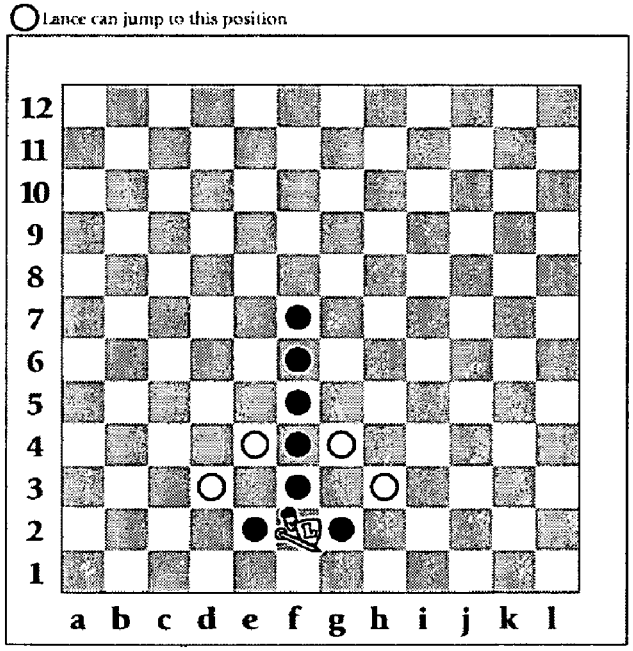
FIG. 27 is a schematic diagram illustrating the movement of a Lance with respect to the Order 10 board.
Figure 28:
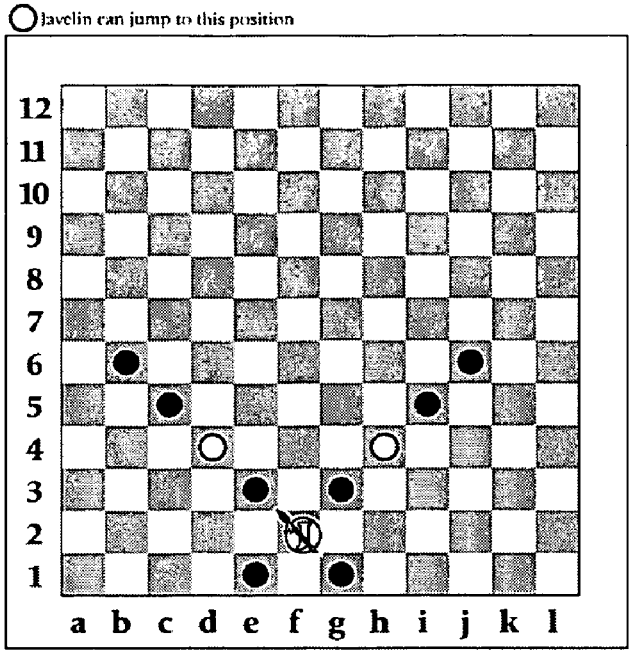
FIG. 28 is a schematic diagram illustrating the movement of a Javelin with respect to the Order 12 board.

Note, that the J and L are not only highly directional, but have a "range". They cannot move an unlimited number of vacant squares like a B or R. Furthermore, their range is different depending on the board size. FIGS. 25 and 26 show the J and L on an Order 10 board. The J has a range of three squares in the forward direction, and the L has a range of four squares. FIGS. 27 and 28 show the movement of a J and L on an Order 12 board; the J has a range of four squares and the L has a range of five squares, all in the forward direction.

Figure 18:
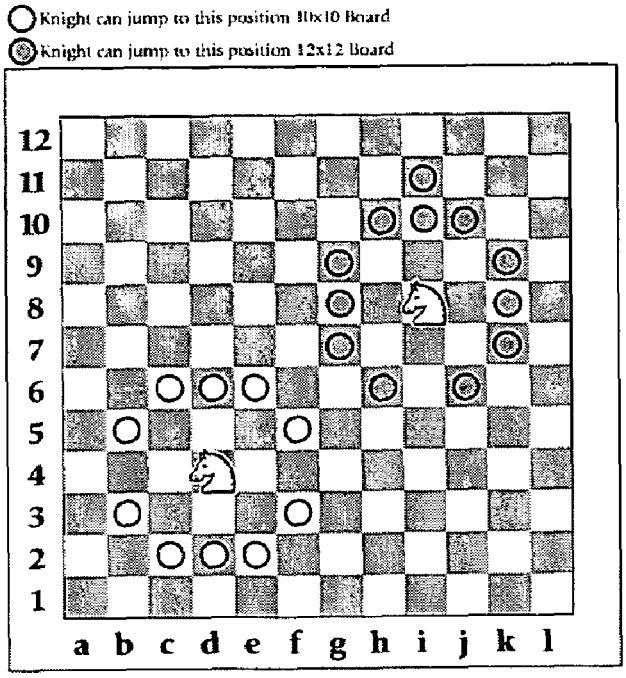
FIG. 18 is a schematic diagram illustrating the movement of a Knight with respect to the Order 10 and the Order 12 board.
Figure 19:
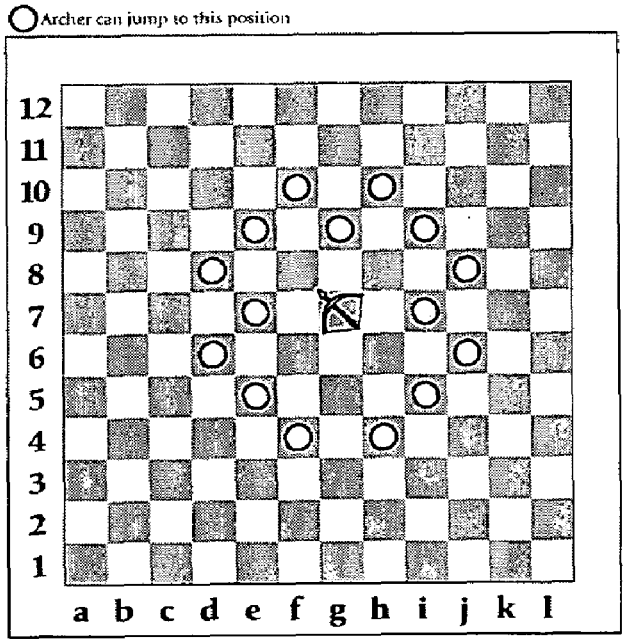
FIG. 19 is a schematic diagram illustrating the movement of an Archer.
Figure 20:
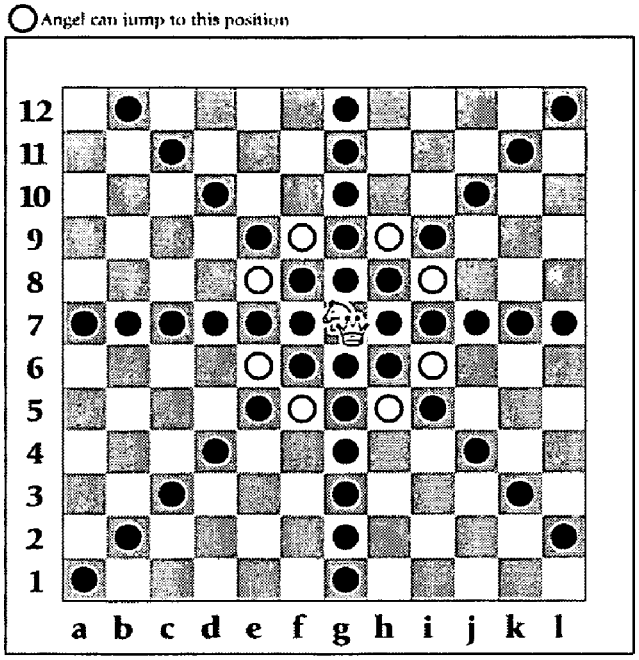
FIG. 20 is a schematic diagram illustrating the movement of an Angel.
Figure 21:
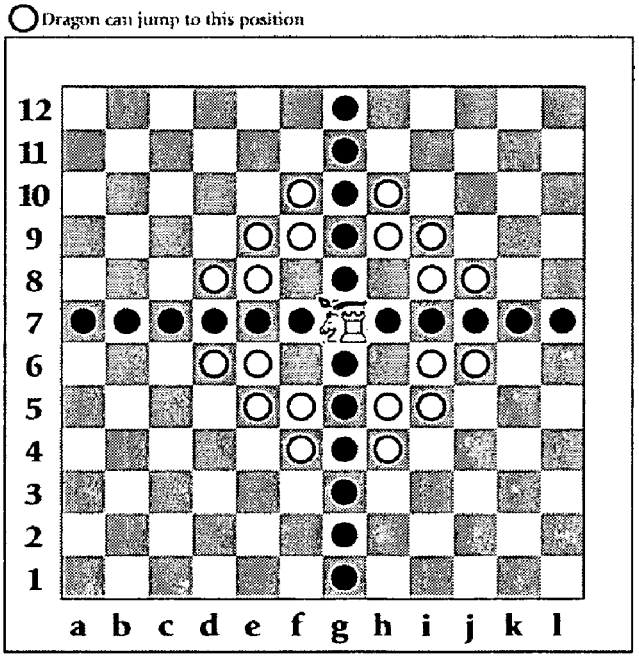
FIG. 21 is a schematic diagram illustrating the movement of a Dragon.
Figure 22:
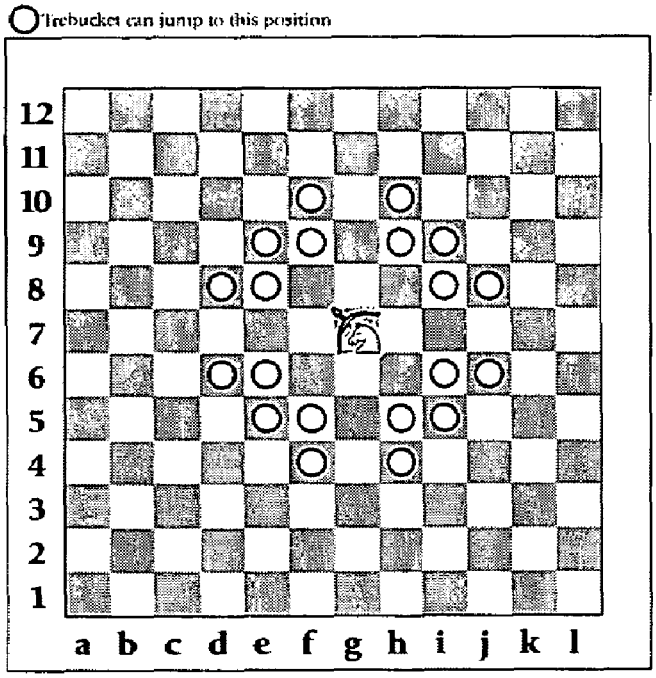
FIG. 22 is a schematic diagram illustrating the movement of a Trebucket.
Figure 23:
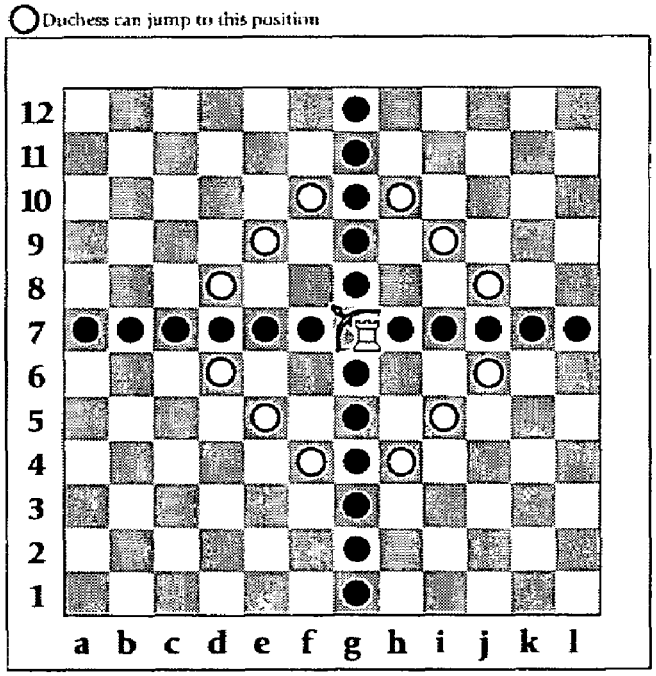
FIG. 23 is a schematic diagram illustrating the movement of a Duchess.
Figure 24:
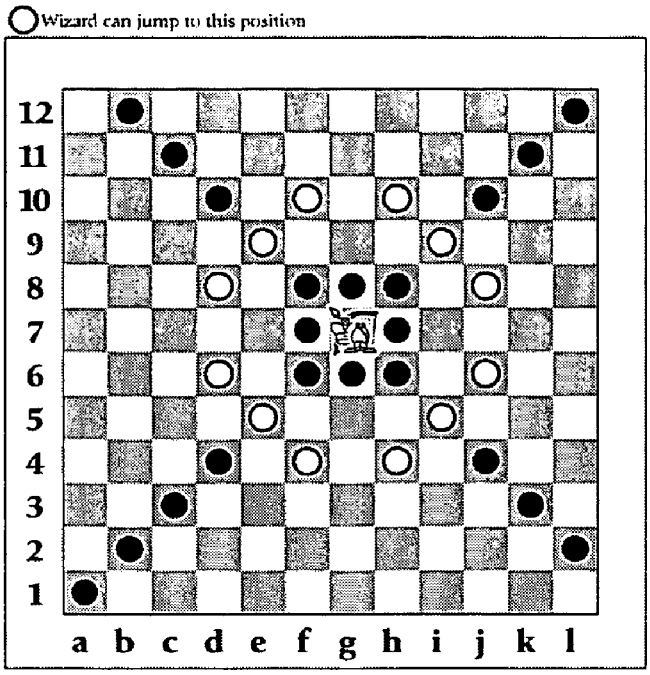
FIG. 24 is a schematic diagram illustrating the movement of a Wizard.
Figure 29:
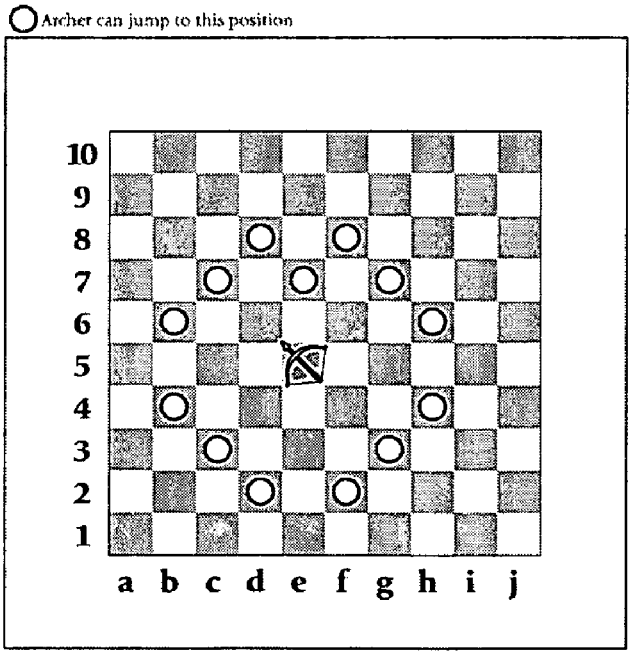
FIG. 29 is a schematic diagram illustrating the movement of the Archer with respect to an Order 10 scalable board.
Figure 30:
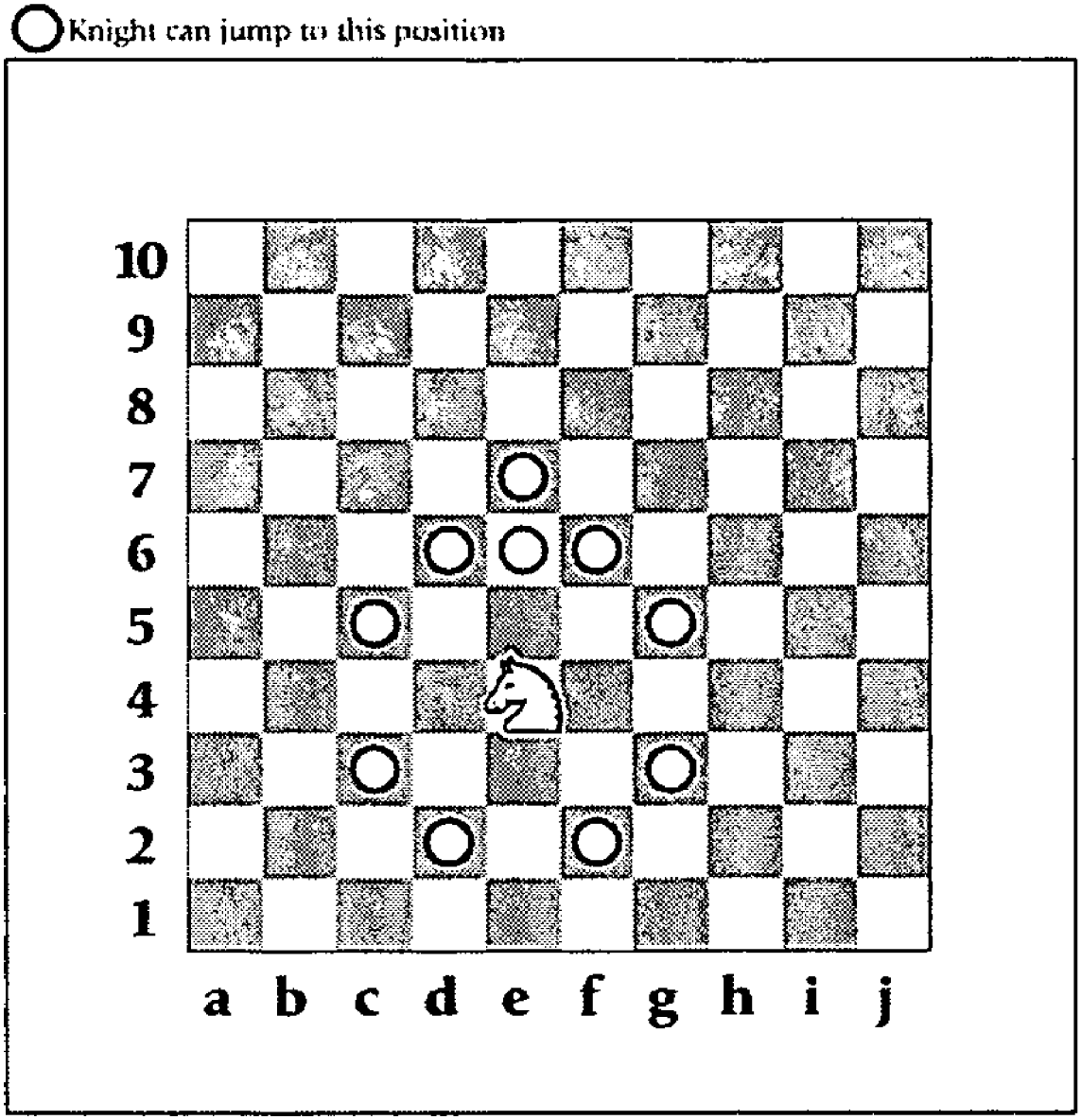
FIG. 30 is a schematic diagram illustrating the movement of the Knight with respect to the Order 10 scalable board.

The A and the N are slightly directional pieces; their prototype movement stencil has been augmented slightly. This is because it is good to preserve the approximately equal strength of the N and B on all boards. On larger boards, the unlimited range of a piece like the B causes it to increase in power compared to fixed rule leapers like the N or A. Thus, a few extra squares to the movement stencil of the N and the A have been added to bring them up to parity with a B. Mathematical piece strength theory predicts that on an Order 10 board the N needs two extra squares and the A, one extra square. On an Order 12 board, the N needs four extra squares and the A needs three. FIG. 18 shows the movement of a N on the Order 10 and 12 boards. FIG. 30 shows the movement of a N in the 10×10 scalable game. FIG. 19 shows the movement of the A on a 12×12 board, and FIG. 29 shows the movement of the A in the10×10 scalable game. In ordinary chess one faces the argument of which is better: the B or the N? In the present invention, the argument is preserved by creating another piece of approximately the same strength, a color bound leaper, the Archer. As in ordinary chess, the determination as to which is better depends on the situation.

Figure 11:
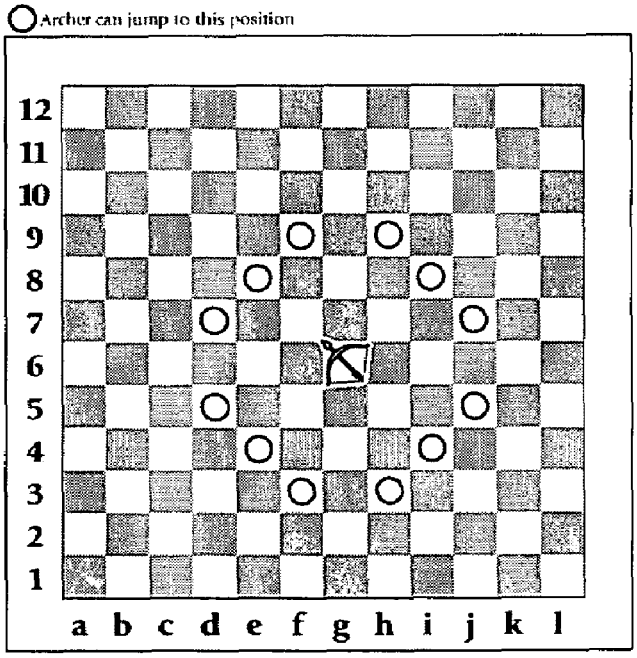
FIG. 11 is a schematic diagram illustrating the movement of an Archer.

Finally, note that the combination pieces like the M or the C are combinations of the prototype movement only, combination pieces NEVER acquire the special augmentation of the N or A on higher order boards. Thus a C is a combination of the B prototype (FIG. 9) and the N prototype (FIG. 10) on all boards. The U is a combination of the R prototype (FIG. 8) and the A prototype (FIG. 11).

Note that the A is like a "long" K, but unlike the N, the A is color bound. The prototype movement (FIG. 11) shows that the A can move three squares forward, and one square to either side; two squares forward and two squares to either side; or one square forward and three squares to either side, and similarly moving backwards. On a 10×10 board, one needs to add one extra square to the Archer's movement to keep parity with a B, this is a two square jump straight forward (FIG. 29). On a 12×12 board, ones need to add two additional squares over a 10×10board to keep parity with a B. A two square jump is also added to either side, as shown in FIG. 19.

Special Moves:

The present invention is a very logical extension of ordinary chess; nevertheless there are a number of special moves that require definition and comment. These are related to Castling, the Canterbury move, en-passant captures, special features of the G and Y, board entry moves for off board pieces, and all moves involving the radical new piece, the Elephant. Note in the following discussion there are some exceptions for the 10×10 scalable game.

The Guard (G):

Diode Ability: In addition to the G move defined in FIG. 12, the G also acts as a friendly force "diode", i.e. the "force" or movement ability of a friendly unit flows through a G, while it blocks the force or movement of an enemy unit, just as it would in ordinary chess. Thus White pieces like a R or a B, may move through a White G as if it was not on the board. However the White G obstructs the movement of Black pieces. Similar rules apply to a Black G and Black pieces. For example, if on a 10×10 board, the Black K is on f9, with a White G on f3, and a White R on f2, the Black K would be in check. This means by extension that one can Castle through a friendly G, although the final location of the K and R may be different than in ordinary chess, see the rules for Castling. Note that multiple G's on a rank, file, or diagonal do not inhibit the diode ability. Of course no unit (except a friendly E) may occupy the same square as an G. Note that a friendly P or Y may move through a G on the bonus move when leaving the Pawn Start Rank (PSR).

Capture Restrictions: A G has no capture ability until it has moved to or beyond the Pawn Start Rank (PSR). On an Order 8 board this is the second rank, where all of the Pawns start. Behind the PSR, a G takes up space, and may deny a K escape squares. Friendly pieces with range can move through a G as described above. On the Order 10 and 12 boards the PSR is the third rank, and on the 10×10 scalable game, it is the second rank.

Acquiring the Pawn Start Rank Move Bonus: A G that attains the PSR, may, like a P, get a bonus move when leaving the PSR. Since the G's normal movement is one square forward, in the 10×10 game the bonus move would be two squares straight forward, while in the 12×12 game, and the 10×10 scalable game, it would be two or three squares straight forward. Note that this bonus move is never a capturing move, and the G may not move diagonally in any way with the bonus move. For example on a 12×12 board, a White G on c3 could move to or capture on b4, c4, or d4 on its next turn, or it could utilize the bonus to move to c5 or c6 as long it did not involve a capture.

Special Back Rank Movement to Attain the Pawn Start Rank: This rule only affects the 12×12 game and the 10×10 game (not the 10×10 scalable game or the 8×8 game). If the squares between the back rank and the PSR on a file are vacant, a G may move 2 squares off the back rank straight forward to get to the PSR in one turn. The G must not jump over any units, capture any units, or move diagonally for this move bonus. For example, on a 10×10 board, if there is a Black G at b10, and b9 and b8 are vacant, the G may move to b8 (the PSR) in one turn. After reaching the PSR, the Black G may utilize the move bonus on its next turn as described above.

The Pawn (P):

Capture Restrictions: Like the G's described above, a P may not make a capture until it at least attains the PSR. This has an effect on the White P's at e1 and f1, and the Black P's at e10, and f10 on the Order 10 board. Similarly on an Order 12 board the White P's at b1, f1, g1, and k1, and the Black P's at b12, f12, g12, and k12 are affected by this rule. Any P's brought on the board, as in the 10×10 scalable game, are also affected. As with G's, P's can be captured by enemy units before they reach the PSR.

Acquiring the Pawn Start Rank Move Bonus: When a P moves off the PSR, it may utilize a special move bonus, as in ordinary chess, and as described above for G's. In the 10×10 game, a P may move two squares straight forward instead of the usual one square when leaving the PSR. In the 12×12 game or the10×10 scalable game, a P may move two or three squares straight forward as a bonus. This move bonus is never a capturing move. Of course a P may also move its normal one square move when leaving the PSR.

Special Back Rank Movement to Attain the Pawn Start Rank: This rule is the same as for the G's. If the intervening squares between the back rank and the PSR on the same file are vacant, a P on the back rank can move directly to the PSR in one turn. This is never a capturing move.

The King (K):

The normal movement of the K is exactly like the K in ordinary chess, one square forwards or backwards in any direction orthogonally or diagonally. When a player moves a unit such that on his next move he could capture the enemy K, he must "warn" his opponent by saying "check". When a K is in check, the only legal moves are ones that get the K out of check: moving the K to a vacant square not attacked by an enemy unit, capturing the enemy unit that is giving check, or blocking the line of force of the checking unit. The K may not get out of check by Castling, making the special Canterbury move, or bringing an off board piece onto the board (except the special parachute units, the Angel or the Dragon, and only if the parachute move limit has not been exceeded). An important principle is that the K may never move into check; that is an illegal move.

When the K is in check, and there is no way to get out of check, one refers to such a situation as a K being in Checkmate, and the player whose K is checkmated loses the game by a full point, 1-0. There is a related position called a Stalemate that in ordinary chess counts as a draw or tie, ½-½. In both Stalemate and Checkmate, the only allowable moves are with the K, and there is no square the K can go to without putting itself in check (an illegal move). However in Stalemate the square the K currently resides on is not under attack by an enemy unit, i.e. the K is not in check. Unlike ordinary chess, it is recommended that this be treated as a ½ point win for the side that "trapped" the opponents K, i.e. ¾ for the winner, and ¼ for the loser.

Castling:

When playing on the Order 8 board, castling is exactly like ordinary chess; it is one move with two pieces. The K moves two squares and the R "jumps" over the K and lands on the vacant square next to the K. Castling can never be used to get out of check, and can never be done with a K or R that has previously moved. Castling can only be done when all of the squares between the K and R are vacant (except for a friendly G, not possible in the 8×8 game). Finally the K may not cross a square that is controlled by an enemy unit (although the R can) and of course the K may not end up in check as a result of Castling. Castling may be done with either R, thus there is K-side Castling and Q-side Castling.

On the higher order boards, Castling is similar to the rules for ordinary chess, and the restrictions described above for ordinary chess are still in force, but there are some important differences. This is due to the additional squares, and the presence of G's, which act as friendly force diodes. The basic rule for the higher order boards is this: the K moves three squares on a 10×10 board, and four squares on a 12×12 board, and the R jumps over the K and occupies the square next to the K. FIG. 31 shows the before and after positions for K-side Castling on a 10×10 board. FIG. 32 shows the before and after positions for Q-side Castling on a 10×10 board. FIG. 33 shows the before and after positions for K-side Castling on an Order 12 board FIG. 34 shows the before and after positions of Q-side Castling on a 12×12 board.

A question arises when a G is between a K and a R. Castling is still allowed because the G acts as a diode to friendly units. However it is possible using the above rule, that in Castling, either the K or R or both would land on a square occupied by a G, which of course is illegal. The present invention still allows Castling by making the K or R or BOTH continue moving in their respective directions until they come to the first vacant square. Thus it is possible to Castle through two Guards. For example, in FIG. 34, if the White G's were on c2 and d2 instead of c1 and d1, then the White K would end up on b2, and the White R on e2. If only one G were in the way, say on d2, then the White K would go to c2, but the White R would go to e2. There are many possibilities. FIG. 35 shows the before and after K-side Castling through one G on an Order 10 board; FIG. 36 shows the K-side Castling through 1 G on an Order 12 board. Q side Castling through G's is similar.

Canterbury:

The Canterbury is a completely new move, that like Castling, is designed to speed up the game, and involves the simultaneous movement of two units, the Archbishop (X), and the Guard (G) in a single turn. The Canterbury can be performed K-side or Q-side. Restrictions on this move are similar to Castling. For K-side Canterbury, all squares between the K and the X must be vacant and not attacked by an enemy unit. Neither the K, the X, nor the G can have previously moved, and the G must be inactive. For example, on a 10×10 board, to perform the K-side Canterbury move for White, the face down G at h1 is turned face up (activated) and moved one square forward to the vacant h2 square. Meanwhile, the X at i2 is moved diagonally backward to the square the G came from, h1. This puts the X on the same diagonal as the K Bishop, an important principle also use in the 10×10 scalable game.

For Q-side Canterbury, all squares between the Q and the X must be vacant, and not attacked by an enemy unit. The Q, X, and G in question cannot have moved previously. To perform the Q side Canterbury for White on an Order 10 board, the G at c1 would be activated, and moved forward to c2, while the X moves diagonally backward to c1. This puts the X on the same diagonal as the Q Bishop. The Canterbury is usually helpful because it prepares Castling (by getting the X out of the way), and brings a valuable defender, the G, up from the back rank, and closer to the Pawn start Rank, where the G can actually do some attacking and defending. FIG. 37 shows the position before and after K and Q-side Canterbury on an Order 10 board, and FIG. 38 shows the position before and after K and Q-side Canterbury on an Order 12 board. Note that the Canterbury move is used in the 10×10 scalable game, but is different from this description.

Board Entry for Off Board Units:

In the present invention, there are several units that start the game initially off the board, and may be brought onto the board during the course of the game. The J and L must enter the board facing forward (north for White, south for Black) on the board squares to which they are adjacent. Thus in the 10×10 game, the White J's must enter at a5 and j5, and the L's must enter at a4 and j4.

Board entry can also occur for parachute units if playing with this rule. Before the parachute move limit, the Angel (@) can be placed on any vacant square, and the Dragon (D) can be placed on any vacant square adjacent to a friendly unit. Note that on the 8×8 board there is no parachute capability.

After the parachute move limit has been exceeded, the @ must enter at the K side corner square (j1 Order 10 board, 11 Order 12 board for White), and the D on the Q side corner square (a10 for the 10×10 board, and a12 for the 12×12 board). The U enters on the same square as the @, and the Won the same square as the D. When playing on the Order 8 board, the @ can enter at either corner square, a1 or h1 for White, and a8 or h8 for Black.

Trebuckets, for Order 12 board and 10×10 scalable game only, enter adjacent to the L's, but one row closer to the Pawn Start Rank (PSR); on the east and west sides of the boards; for White a3 and j3 for the 10×10 scalable game, and a3 and l3 for Order 12 boards, and similarly for Black. Elephants must enter on the north and south sides of the board in the center. For example White E's enter at e1 and f1 Order 10 boards, and j1 and g1 Order 12 boards. For Black, E's enter at e10 and f10 for Order 10 boards, and f12 and g12 for Order 12 boards. Note E's enter already mounted in the 10×10 scalable game, and Pawns need to enter on files where there are Y's in the Initial Position.

Except for the parachute rules, bringing a unit onto the board can not be used to block check, and it is never a capturing move. A board entry move, may however, give check. Except for the E, the board entry move must be to a vacant square, and the unit that entered the board can be immediately captured by an enemy unit. The blocking and control of board entry squares is part of the strategy in the present invention.

Figure 12:
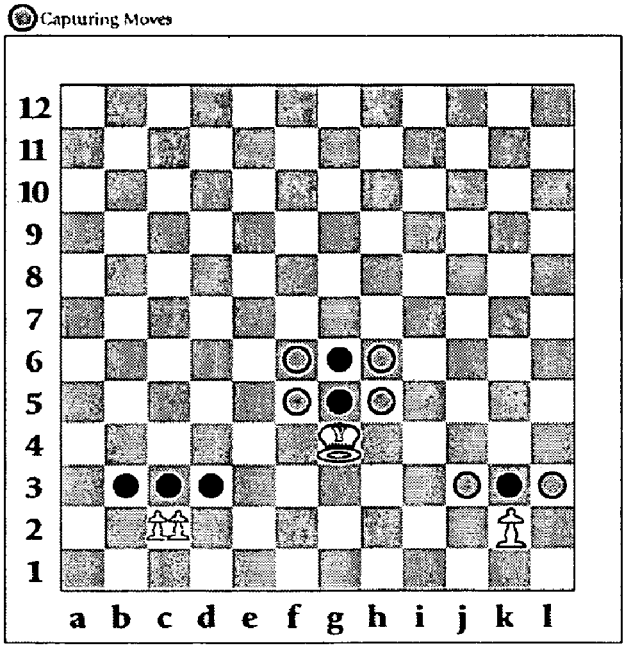
FIG. 12 is a schematic diagram illustrating the movement of a Guard, a Yeoman, and a Pawn.

Yeoman: (Y) Super Pawn:

Movement: The Yeoman (Y) movement and capture stencil is shown in FIG. 12. The Y is used only on the 12×12 board, and in the 10×10 scalable game. The Y is a promotable unit, like a P. Upon reaching the Promotion Rank, it can be immediately replaced by any piece except an @ or a D. The initial position of the Y is on select files (to provide interlocking defense with the A's) on the Pawn Start Rank (PSR) (see FIGS. 6 and 7). Like the P, the Y gets a move bonus when leaving the PSR; it can move one, two, or three 3 squares allowing it to come to the center of the board on one turn. The bonus move leaving the PSR is never a capturing move. After leaving the PSR the Y moves straight forward, like a P, but the Y may move one or two squares per turn, e.g., it is twice as fast as a P when racing to the Promotion Rank, which makes it very dangerous. The notion of a "passed Y" is different than a "passed P" because an enemy P on an adjacent file is unable to stop a Y by itself due to the two square move of the Y. Thus it is much easier for a Y to become "passed" than a P.

Capture: The Y is like a P in another way; it captures differently than it moves (see FIG. 12). The Y can capture on a total of four squares. Two of the capture squares are just like a P, 1 square diagonally forward to either side. However the Y has an additional capture ability. If the square immediately in front of the Y is vacant, the Y may move one square forward (like a Rook), and then from there capture one square diagonally forward, adding two more capture squares. These special capture squares are shown in FIG. 12 and are designated with a gray circle in the square. For example if a White Y is at g6, and a Black B is at h8, and the g7 square is vacant, then the White Y may capture the Black B. Note, that the White Y may not move to f8 because that would not be a capture move. If there was a Black unit on f8 (not an Elephant or another Y, see exception below and the E rules for capture) the White Y could capture either Black unit. Counting the square the Y occupies, and the 4 capture squares, forms a "Y" shaped stencil, which may help in remembering the extended capture capability of the Y.

Zone of Control—Exception to Extended Capture Rule Above: There are two exceptions to the extended capture rule discussed above; one is for E's, and the other is for enemy Y's. The two squares immediately diagonally forward of the Y (the normal Pawn capture squares) are said to be in the Y "Zone of Control" (ZoC). The ZoC of the Y affects the movement of all promotables, but not pieces. The ZoC rule is that any promotable that attempts to move through a Y ZoC, must instead stop on the Y ZoC square ending the turn. On the next turn, the enemy promotable may move off the Y ZoC square unimpeded. In the above example, if there is a White Y at g6, and a Black Y at f8, the White Y may not capture on f8. The Black Y at f8 exerts a "Zone of Control" over the vacant square g7, and so the White Y must stop at g7, ending the White turn. Note that the Black Y at f8 may not capture the White Y at g6 because the White Y has a ZoC on the square f7, so the Black Y must stop at f7. The ZoC affects both capture and movement; the White Y at g6 cannot move to g8 in one turn; it must stop on g7, a ZoC square of the Black Y at f8. This concept affects and simplifies the en-passant rules.

Delayed Promotion:

The Y has a special new promotion rule when it has attained the last rank or Promotion Rank (PR). This rule is only for a Y. If a Y "under promotes" to an A, N or B, the Y is removed from the game, and the A, N, or B is placed on the promotion square, just as in ordinary promotion. However, because the player did not pick an M, C, U, F, or T (combination pieces of two, and only two prototypes, and all of which are stronger than an A, N, or B) he may use the other piece of a two prototype combination piece as a parachute unit that may be played anywhere on the board (but not to block check) up to "n" turns in the future, "n" being the board order. He must define the parachute piece at the time of promotion. If the player with the parachute piece in reserve is unable to play the parachute unit by the move limit, he loses that piece. For example, suppose a Y under promotes to a N at move fifty. The player under promoting removes the Y, places a N on the promotion square and declares "delayed promotion" and defines an A as his parachute unit (N+A=T; so this is the other half of a two prototype combination piece). He may then parachute the A onto the board at any turn up to and including move sixty. The usual restrictions apply to parachute units, they must parachute onto vacant squares, and they can not be used to block check, but they may give check on a board entry move. If the opposing player was then able to force a series of ten checks, the delayed promotion player would forfeit the A that was waiting to be parachuted. This is another rule that will make it very difficult for computers to analyze a game, although delayed promotion is a rare occurrence, and almost certainly fatal to the other player.

Elephant (E):

The Elephant is the most unusual piece in the present invention; there is no analog of the E in ordinary chess. One may regard the E as optional; the present invention is quite playable without it. However the E is a dynamic piece, and learning the proper use of the E adds new dimensions to the game (again making computer analysis very difficult). Because the E derives its strength not from the number of squares it can move to, its strength may not be determinable. The E derives its power from its immunity to frontal attacks, its ability to transport and then off load a company of promotables, and its special stampede rule. During the design of the game it was thought its primary use would be to break open a fortress K position. It may be considered a very dangerous piece.

Figure 13:
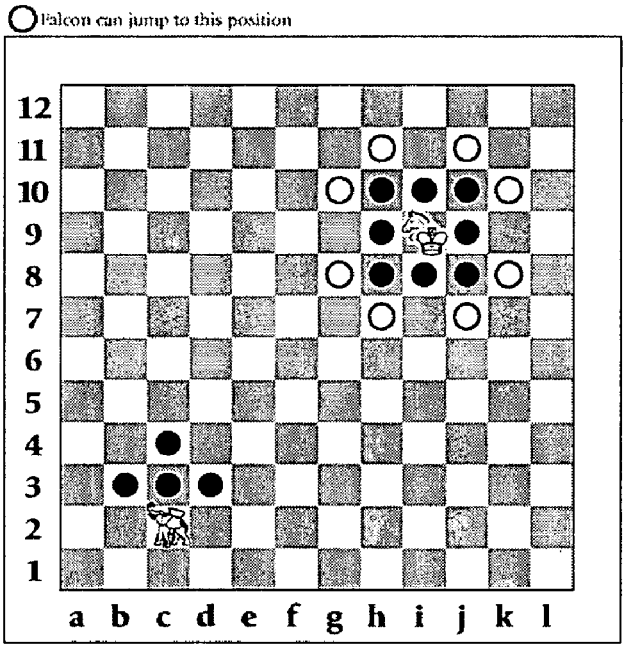
FIG. 13 is a schematic diagram illustrating the movement of an Elephant and a Falcon.
Figure 14:
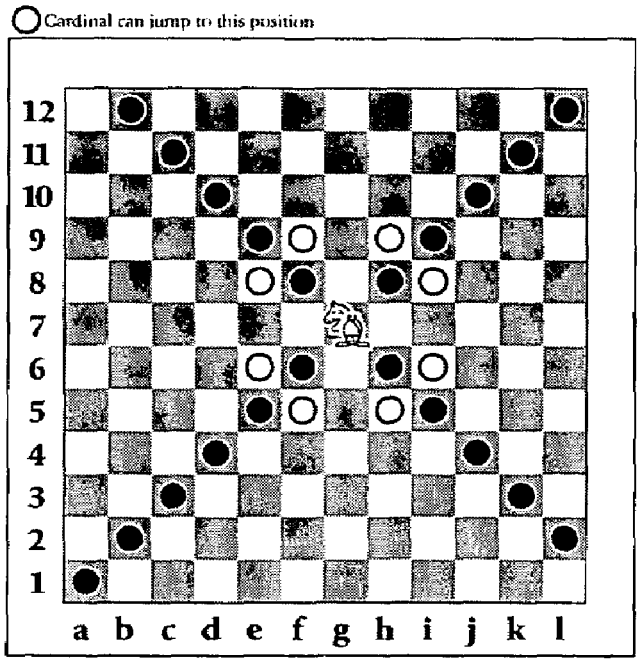
FIG. 14 is a schematic diagram illustrating the movement of a Cardinal.
Figure 15:
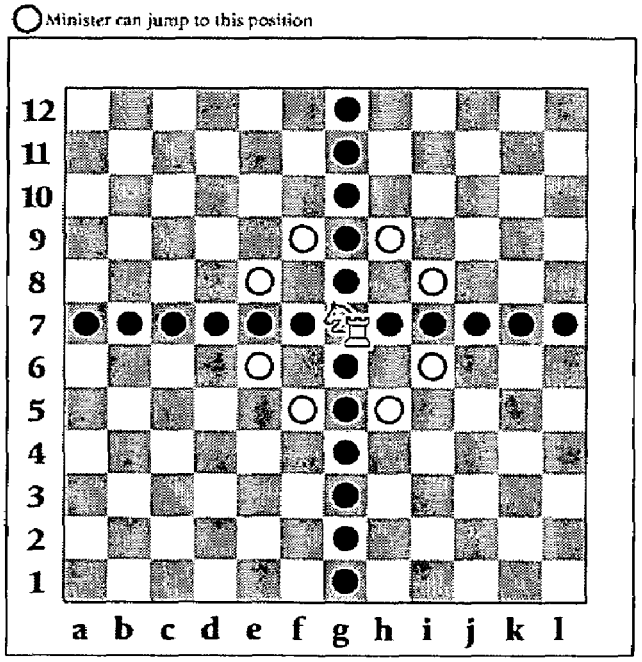
FIG. 15 is a schematic diagram illustrating the movement of a Minister.
Figure 16:
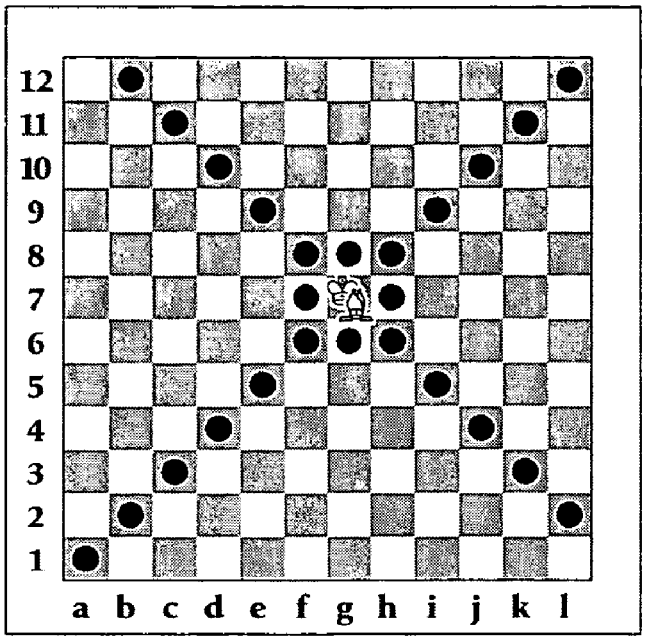
FIG. 16 is a schematic diagram illustrating the movement of an Archbishop.
Figure 17:
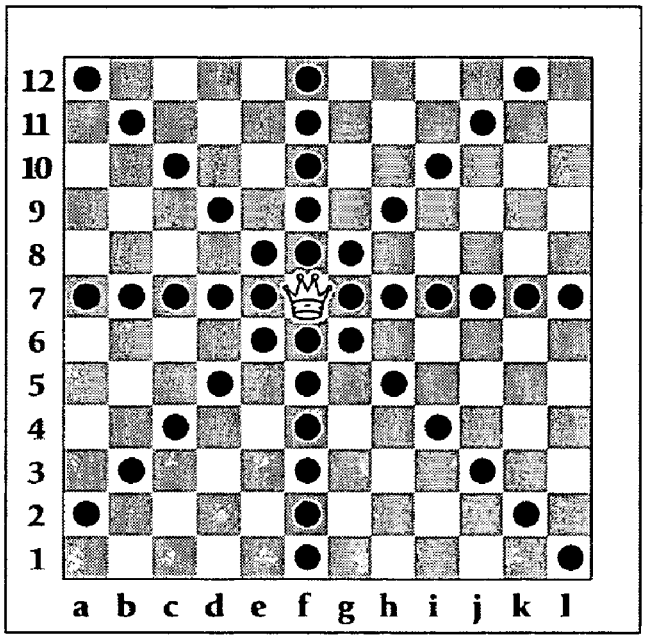
FIG. 17 is a schematic diagram illustrating the movement of a Queen.

The rules and limitations associated with the E may be summarized as follows. The E is a transportation piece; it can carry combinations of promotable units, (P,G, and Y) up to a total of four, to other squares on the board. The promotable units may "mount" and "dismount" from the E. E movement is unaffected by mounted promotables, and the promotables have no attack or defense capability of their own while they are mounted. The E is a directional piece; it cannot change square locations and facing direction on the same turn. The way the E is facing is very important, because that defines the "front" which is important for capture rules. The E is initially off the board, and must enter the board on specific squares (first rank, of the K and Q files), and board entry moves cannot be used to block check, and are never capturing moves. The E is completely immune from capture by an enemy unit that is "in front" of it (except by an enemy E in a special situation called an E Ram). To capture an E, one must attack it from the side or rear. The E is immune to captures by promotables, front, side, or rear. An E can be "frozen" or immobilized by being attacked by any piece (not a promotable) except the K. Note, that the E may still dismount units while "frozen". The E is allowed special non-capturing bonus moves along the back rank to pick up promotables like G's and P's. Like other units it is allowed to move through friendly G's. It also is allowed a special bonus move the first time it moves off the back rank. The normal E movement is shown in FIG. 13. The E has a special move called a "stampede" where it can move two squares forward (like an R) in one turn, including the ability to capture two units on that turn, After a "stampede" the E must rest (may not move) for one turn. The E can blockade (E Ram) and exchange itself (E exchange) with an enemy E, when facing head to head on adjacent squares. The best defense against an E is another E.

Elephant Specific Rules and Limitations

Transportation—Mounting: The E can carry any combination of promotable units (P,G, or y) up to a total of four. The E can not carry any piece, A promotable unit is considered to be carried by the E or "mounted" when the E occupies the same square as one or more promotables. Mounting occurs when an E moves onto a square occupied by a friendly promotable; the E tile is placed on top of the promotable, producing a stack of friendly units. This is the only time when more than 1 unit can occupy the same square. The content of the stack is never a mystery; an opponent may examine the stack at any time during his turn, and a player may examine his own stack at any time without invoking the touch move rule. A P, G, or Y may never move onto a square occupied by an E or an E stack. Mounting occurs only when the E is doing the moving, never when a promotable is moving. Only one unit may be mounted per turn. An E may never be mounted by a promotable and make a capture on the same turn. An E may never move onto the square of an inactivated unit; to mount the unit must first be activated, which costs a turn. An E may move onto the board, and in doing so cause a P, G, or Y to be mounted. This is the only case where a board entry move can be made to a non-vacant square.

A mounted E moves and captures just as an unmounted E. The mounted units have no effect on the E, or on the game, thus the mounted promotables may not capture while they are being carried by the E. Mounted units may not be attacked and captured separately from the E they are riding on. When an E is captured, all of the mounted units are lost as well. An E may move to the Promotion Rank, but this has no effect on the mounted units, i.e. they are not promoted.

Transportation—Dismounting: Units that are on the E may leave the square of the E; this is called a "dismount" move. A mounted unit may dismount by moving to any vacant square adjacent to the E, including the square "behind" the E. The dismount move is independent of the unit dismounting and is never a capturing move, or a check blocking move. Thus, the dismount move of any unit is like the move of a K. If there are no vacant squares adjacent to a mounted E, then no dismount moves are permitted. Only one unit may dismount per turn, and once dismounted the unit functions as it normally would for capture and movement. A dismounted unit may be immediately captured by an enemy unit. Units may not dismount to the Promotion Rank (PR) but they may dismount to any other vacant square and on a subsequent turn move to the PR. Since all of the promotables are directional units, they must dismount facing in the default direction, north for White, and south for Black. If a unit dismounts to a square that gives a move bonus when leaving that square, the dismounted unit is entitled to that bonus even if it had used that bonus earlier in the game. Similarly any capture restrictions that are in effect for that square are still in effect for dismounted units. When a mounted E moves, it moves with the whole stack. It may not move and leave behind or "shed" mounted units. The only way mounted units on an E may be reduced is with the dismount rule.

Elephant Board Entry: The E is initially off the board, behind the Back rank, and centered, one on the Q side, and 1 on the K side. They must enter the board at specific squares that are either vacant or occupied by a friendly activated promotable unit. On a 10×10 board, the board entry squares for White E's are e1 and f1 facing north. For Black they are e10 and f10 facing south. Board entry squares are never capturing moves and cannot be used to block check. The E's may be immediately captured after entering the board. If a board entry square is occupied by am enemy unit, the E is effectively blocked from entering the board. Each E has a single board entry square; both E's may not come onto the board at the same square, for example because one board entry square is blocked. The blocking and control of board entry squares is part of the additional strategy of the present invention.

Elephant Move is Directional: The Elephant is a directional piece, it moves and captures like a G, as shown in FIG. 13. It is a slow lumbering piece. Unlike a G, the E is a piece, so it may turn its facing direction, which counts as a turn. It cannot change square locations and facing direction in the same turn. The facing direction of an E is important for both movement and capture. The E has one other movement and capture ability called the stampede.

Elephant Immune from Capture by Promotable or Frontal Capture by a Piece: The E is completely immune from capture by any promotable. The E is also completely immune from capture by an enemy piece that is attacking it from the "front" (exception, see Elephant Ram and Elephant Exchange, below). The definition of front depends on the facing direction of the E; normally for White front means north, but if the E changes its facing direction the definition of front changes accordingly. The E may be captured and removed from the board, like other units, if it is attacked by a piece from the side or rear. For example if a White E is at f6 facing north, and a Black R is at f11, it cannot capture the E (frontal attack) but a Black R at a6 could (side attack). If the White E is facing west, the Black R at a6 cannot capture the E (frontal attack) but the R at f11 could (side attack). In another example with jumping pieces a Black N at d7 could not capture the White E at f6 facing north (frontal attack) but a Black N at d5 could (rear attack). Note that a Black E at e6 facing east could capture a White E at f6 facing north (side attack).

Elephant Immobilized by Piece Attack: The E can be "frozen" or immobilized if it is attacked by any piece (except the K). Note, an E is not frozen when attacked by a promotable (e.g., P, G, or Y). The attacking piece can be anywhere, front, side, or rear of the E, it does not matter for freezing. Naturally if the attacking piece is in front of the E it cannot capture the E. A frozen E may not move which means it cannot even change its facing direction. A frozen E is still allowed to dismount units, 1 per turn, since that is not an E move. Dismounting mounted units from a frozen E may unfreeze the E by blocking the line of force of the attacking piece. Note that this method of unfreezing a frozen E will not work with jumping pieces or the jumping portion of a combination piece. Freezing an E and then sending pieces around to the side or rear of an E is one of the best ways to capture an E.

Elephant Bonus Moves On and Moving Off the First Rank: These rules are designed to speed up the game, and are the result of significant play testing. They allow the E and any mounted units to quickly assemble in assault mode against an enemy K position, without completely changing the tactics and strategy of the game. When an E is on the First Rank, it has special bonus moves (non capturing) that allow it to pick up promotables quickly. On a 12×12 board, the E may move sideways like a R (without changing facing direction) along the Back Rank for a range of up to five squares. If it lands on a square of an activated promotable, the promotable "mounts" the E as described earlier. Note, that the E can move through a G. This is the only time that a directional piece may move in a direction that it is not facing. This move may be used to block the occupation of a square by an enemy unit as in promotion, but it cannot be used to make a capture or block a check. The E may be in any facing direction when making these moves, but it must be on its back rank. There is no limit to the number of these kind of moves an E can make, the only restriction is that it must be on its Back Rank. The rules for a 10×10 board are similar, but the range is reduced to four squares.

When the E, mounted or not, leaves the Back Rank it also gets a move bonus; it is allowed to move five squares forward Q to any square that is vacant, or occupied by a friendly promotable, subject to the stacking limitations of four promotables per E. This move is also non-capturing and cannot be used to get out of check. For this move, the E must be facing forward, north for White and south for Black. If an E ever returns to the Back rank during the game, it can use these same bonus rules again. Note, that a Black E on the White Back rank does not get any bonus moves, because for Black that is the Promotion Rank. The same obviously applies to White on Blacks Back rank. The rules are the same on a 10×10 board, except that the range is reduced to four squares.

Elephant Stampede: This is a special move where the E can move two squares forward (like a R) instead of the usual one square. However, the difference is that both squares could be occupied by enemy units, thus the E could capture two units on one turn. For example, if Black had a P on f5, and a R on f6, and White had an E on f4 facing north, with White to move the E could "stampede" and move to f6 capturing both the Black P at f5, and the R at f6. However, if Black had a N (facing south) on d5, the White E would be frozen and could not move at all. If Black had a G at f5, instead of a P, the E would be frozen by the Black R because of the diode nature of the friendly G. After an E has made a stampede move, it cannot move, turn, mount, or dismount units, it must rest one full turn. An E cannot stampede if it would capture or "run over" any friendly units. A stampede is not allowed if it would result in the frontal "capture" of an enemy E (an E can never be captured frontally (see Elephant Ram and Elephant Exchange, below). After its rest turn is over, the E can be used to make another stampede. An E that has made a stampede on its previous move, may be captured by an enemy piece on its rest turn. Be careful of the stampede allowing stalemate; if an E has just made a stampede, and the K of the same color has no legal moves, and there are no other units to move, the K is stalemated which is a ½ point loss.

Elephant Ram and Elephant Exchange: The Elephant Ram occurs when two E's of different colors, face each other Rook wise, head to head, with no intervening squares. For example, a White E on d5 facing north, and a Black E on d6 facing south is an Elephant Ram. In the Elephant Ram, the normal one square forward diagonal move is not allowed. Since neither E can be captured frontally, the normal straight forward move is also not allowed. Thus each E is essentially frozen. E's in a Ram situation can dismount units one per turn. E's in a Ram can be captured from the side or rear by other pieces.

In a special move, called the Elephant Exchange, the E's in a Ram can be exchanged (i.e., both E's and all of their mounted units are removed from the board). The side on move has the option of declaring an E Exchange, and thus can only occur if the E's are already in a Ram situation. In this example, Black to move could declare an Elephant exchange, and remove his E (and all mounted units) at d6, along with the White E at d5 (and all mounted units). One cannot move to produce a Ram situation and dismount units or declare an Elephant Exchange in the same turn. This means that the "defender" E has the first opportunity after a Ram to dismount units or declare an Elephant Exchange. An E can stampede to produce a Ram situation, but in that case, the defender would have an extra move to dismount units or declare an Elephant Exchange, since the stampeding E would have to take a rest turn. Usually the E with the most mounted units is the most dangerous because he can dismount more attackers at the critical point in the battle. However the Elephant Exchange rule above means that one has to be careful that one does not lose material in the Exchange, and the E with the most mounted units is at more risk.

En-Passant Capture

En-Passant (abbreviated e.p.) rules in the present invention are a simple and logical extension of the rules for ordinary chess. First, when playing on the Order 8 board, G's function exactly like P's when they attain the Pawn Start Rank (PSR) for the purpose of en-passant. However in the present invention there are three promotables (P, G, and Y) that might be involved in e.p. capture; on higher order boards there are more squares for e.p. rules to come into play. Finally the Y can normally move two squares, and has a special ZoC rule that affects the e.p. rules for promotables.

The principle of e.p. with respect to conventional chess is described as follows. One P, the one that is going to be captured (the "victim") is on the PSR, and is going to be moved. An enemy P (the "attacker") is on an adjacent file to the victim, and has attained the 5th rank (4th rank from the victim's perspective). Normally P's move one square straight forward, and if the victim P did that it would be subject to capture by the attacker on the fifth rank. However, the victim P uses the special move bonus when leaving the PSR to move two squares forward. This puts the victim one square beyond where the attacker P on an adjacent file could make a capture.

The e.p. rule says that on the turn immediately following the victim P's move off the PSR, (and only on the next turn) the attacker P may capture the victim P anyway, just as if the victim P had not made use of the bonus move and had only advanced 1 square forward. Thus the attacker P removes the victim P, and moves his P 1 square diagonally forward.

The principle of e.p. is similar in the present invention. The attacker promotable must be at least in the enemy half of the board; for Order 10 boards, that means the sixth rank or better, for Order 12 boards the seventh rank or better, counting from the attackers first rank. The victim promotable must be on an adjacent file and on some rank where it gets a bonus move rule in addition to its normal move. For the 12×12 game or the 10×10 game, this would be either the PSR or the Back Rank, for the 10×10 scalable game and the 8×8 game, it would be the PSR.

e.p. Rule for 8×8 Game (Guards and Pawns):

This is the most similar to ordinary chess. Either P or G can be the attacker or victim. The G is the only new promotable, and for e.p., it functions exactly like a P. The victim promotable must be on the PSR and exercise the bonus move of two squares. The attacker promotable must be on an adjacent file and on the fifth rank (and no other rank).

e.p. Rule for 10×10 game (Guards and Pawns):

The Order 10 game (not the 10×10 scalable game) is also very similar to ordinary chess. Again the only new promotable is the G, and as in 8×8 game, the G functions exactly like a P for the e.p. rules. The only difference is that there are two ranks where a promotable gets a bonus move rule: the PSR and the Back Rank. For example, suppose the White promotable (P, or G) is on his sixth rank, say c6 (the attacker) while a Black promotable (the victim) is on the PSR (his third rank) on an adjacent file, say d8. When Black tries to use the bonus move leaving the PSR by moving his promotable to d6, the White promotable can capture the victim promotable, remove it from the board and move his promotable to the square d7.

The only other way e.p. could happen in the Order 10 game is when the move bonus is used in moving from the back rank to the PSR. For example, if a White promotable was at d8, and a Black promotable was at c10 (on the back rank) and then moved to c8, using the bonus move rule, the White promotable (attacker) could capture the Black promotable (victim) remove it from the board, and put the White promotable at c9. Obviously, these examples work in reverse with Black being the attacker and White the victim.

e.p. Rule for 12×12 Game (Guards and Pawns):

The e.p. rules for the 12×12 game and the 10×10 scalable game are the most complicated. The rules for P's and G's are very similar to the rules for the 10×10 game discussed above, except that the move bonus for leaving the Pawn Start Rank (PSR) is now two or three squares, instead of just two squares. This means that there are more squares where e.p. rules apply. Thus the attacker can be on the seventh or eighth rank, while the victim P or G is on the PSR. For example, if there is a Black P or G at c6 (attacker) and a White P or G leaves the PSR (victim) and moves to d6 (move bonus), Black could capture removing the White unit and putting the Black P or G at d5. Suppose the Black P or G is on c5 instead of c6, and White moves to either d5 or d6. Now Black could capture e.p. and move his unit to d4. The only other e.p. situation in the 12×12 game would be if a P or G was on the back rank and utilized the move bonus to avoid an enemy P or G on an adjacent rank, just as in the discussion of the 10×10 game.

e.p. Rule for 12×12 Game and 10×10 Scalable Game for Yeomen: The e.p. rules for the Y may appear to be different, however, the preceding principle is followed. What is different, is that the normal movement for a Y is one or two squares straight forward per turn, not just the one square limitation of the P's and G's. Thus, when a Y moves two squares leaving the PSR, it is a normal move, not a bonus move. The Y also has a Zone of Control (ZoC) that restricts the movement of all promotables, including enemy Y's. Let's look at some examples from the 12×12 game.

First, suppose the Y is the attacker. If a Black Y has reached f6, and White wants to move a P or G from e3 (on the PSR) to e6, one might think that the e.p. rule would apply. However the ZoC rule makes the e.p. rule unnecessary here. With a Black Y at f6, both e5 and g5 are in the ZoC of the Black Y. Therefore all promotables trying to move through the YZoC must instead stop in the ZoC square, in this case e5. One difference between this case and usual e.p. is that if Black refuses to capture on e5, White may capture the Black Y on his turn. If the Black Y had reached f5, then e4 and g4 would be in the ZoC, and the White P or G would have to stop at e4.

Finally, suppose the Y is the "victim". The only way this could happen is if the Y is on the PSR and the attacker P or G is on the 7th rank (first rank just into the enemy half of the board). If the Y moves one square off the PSR, no e.p. If the Y moves two squares off the PSR, the normal movement for the Y, no e.p. because it is subject to a normal attack by the attacker. If the Y uses the bonus and moves three squares off the PSR, there is now an e.p. situation, and the attacker is allowed to play as if the Y had only moved two squares off the PSR and capture accordingly. If the attacker promotable is on the eighth rank, no e.p. is possible with a Y as the victim because the normal move of the Y (two squares) brings it past the attacker, thus the Y may use the bonus move without creating an e.p. situation. An e.p. situation cannot be created from the Back Rank with the Y as a "victim" because the Y normal movement is the same as the bonus move.

e.p. Rules for the 10×10 Scalable Game:

The e.p. rules for the 10×10 scalable game are the same as for the 12×12 game described above, except simpler since there is no Back Rank bonus move to get to the Pawn Start Rank. All other examples for the 12×12 game have been previously discussed.

Relative Strength of the Units

In the present invention, as in ordinary chess, it is important to know how strong each piece is. The present invention introduces many new units, pieces and promotables, unknown to ordinary chess, and uses them on larger boards. Board size is one factor that affects the strength of chess units. Most chess variants give the players no idea of the strength of their new pieces, (the developers do not know either) and the ones that do often give inaccurate values. One can find some information in publications, either print or on the Internet, but such is not very good. The inventor of the present invention has a strong background in applied mathematics and computer programming, which was used to develop a simple theory, that predicts piece values on any board size. This theory was developed from the known piece values on an 8×8 board, and a linear extension to higher order boards. The theory contains correction factors for uni-color pieces (e.g. the B, or A), jumping pieces (e.g. the N, or A), directional pieces (e.g. the J, or L), combination pieces (e.g. the C, M or @) and of course the promotables (P, G, and Y).

Accomplished chess players should note some of the refinements to the usual chess piece values on the 8×8 board. A Bishop is worth 3¼ not 3, and a Rook is worth 4¾, not 5. This explains why a B is generally worth more than a N, why a B pair is often said to be worth an extra ½ point, why two minor pieces are better than R+P, why a B pair is almost worth R+2P, and finally why 3 minor pieces are slightly better than a Q. One may be relatively confident of the values except where a "?" occurs. It is difficult to value an E accurately (it is like no other ordinary chess piece). There is also some uncertainty about the G and Y, because they have significant capture abilities that a P does not have. Also the G and Y are harder to stop on an open board than a P; a R cannot stop a G by sitting on a particular file because the G can move diagonally and change files. A R can stop a G on a rank, but not a Y because the Y can move 2 squares per turn.

The extra squares added to the movement of the A and the N give them full tactical equality with a B in the middle game, but in the ending they will find it difficult to contend with P's on both wings, which is similar to ordinary chess, just expanded a bit. One should note that in a K+G vs. K ending, it is a 1-0 win for the G, and if the G can "front" the Y, a K+G vs. K+Y ending is won for the G.

Scalability

The present invention is referred to as being scalable because one can decide how many extra pieces to include. FIG. 7 shows the most complicated setup which for exemplary purposes is referred to as Case A. Every unit except the Falcon (F=K+N) from the 12×12 game is used, although there are fewer P's and G's in the scalable game. Simpler variations can be described as Case A, but with some pieces removed as follows: Case B =Case A, but remove the Trebuckets; Case C=Case B, but remove the Javelins, and Lances; Case D=Case C, but remove the Elephants; Case E=Case D, but remove the Guards; and Case F=Case E, but remove the Duchess and Wizard. Thus, it is to be understood that these combinations are not to be considered as limiting and that other combinations or alterations may be possible. For example, the E's may already be mounted with one P and two G's to speed up the game.

Scalable Order 10 Chess Game

The 10×10 scalable game offers most of the features of the 12×12 game, but on a smaller board with fewer pieces, and therefore allows for faster games. It is an ideal compromise that is very playable. This version incorporates both the Archer, the new prototype color bound leaper that is approximately as strong as a Bishop, and the super fast promotable, the Yeoman, which moves twice as fast as a Pawn. The Archer is a very exciting piece to play. In the opening, it functions like a N in ordinary chess because it can threaten enemy central Pawns or Yeomen on its initial move coming off the back rank. The Yeoman's speed makes it a very dangerous promotable; it can slip past a P on an adjacent file without being captured. Combination pieces based on the Archer are also used, like the Trebucket (T=N+A) which is stronger than a Rook. The only unit in the 12×12 game not used in this game is the Falcon. This very playable game offers tremendous scope for strategy, tactics, and ingenuity, including discovering completely new openings.

Interlocking Defense with Archers and Yeomen:

The initial setup is shown in FIG. 7. FIG. 12 depicts the movement of the Y and FIG. 29 depicts the movement of the A on this board. One should be familiar with the interlocking pattern of defense formed by the Y's and the A's in the initial setup. This keeps enemy pieces out of the two ranks in front of the Pawn Start Rank (PSR). For example, for White, the four Y's cover the squares b4, d4, e4, f4, g4, and i4, while the two A's cover the squares a4, c4, h4, and j4, which is every square on the fourth rank. This prevents the first player from gaining too much of an advantage using opening A moves, which otherwise would be able to attack enemy pieces on the Back Rank with complete immunity, including delivering wicked checks. One should be careful though, because once the A's or Y's move from their initial squares, entry points will be created for the enemy A's or even the parachute movement of the @ or D.

Special Knight Movement in 10×10 Scalable Game:

FIG. 30 shows the movement of the N in this game. Notice that the "spike" movement of the N can be allowed (e.g., being able to move from h1 to h4) because of the interlocking pattern of defense of the A's and Y's discussed above. This makes the N a fine offensive piece. Basically, to keep parity with a B on the Order 10 board, the N needs two additional squares, and the A needs one. This makes the N and the A slightly directional. Thus in the present invention, the argument is preserved as to which is better: a N or a B, and have it further complicated by adding another piece of approximately equal value, namely, a color bound leaper, the A.

Stacking of Archers and Archbishops in Initial Setup:

In the initial setup (FIG. 7), if the X's are initially off board right behind the A's, the N, and R on the Back Rank and the P in front of the A are all undefended, both K and Q side. This gives the possibility of a devastating attack by the first player on these undefended points, and an unbalanced game. However, the only obvious way to fix this problem is to replace the A's with Xs. That would however ruin the early attack on the central squares that the A's provide. The solution is to put both the A and the X on the same square, on the back rank between the N and the R in the initial setup. Once the A or X moves, they may never occupy the same square again; this only occurs in the initial setup. If a capture is made by an enemy unit on a square with a stacked A/X combination, both units are lost. In the other embodiments of the present invention, the Elephant and promotables are the only units allowed to stack. So this is the only other time that more than 1 unit may occupy the same square at the same time. Note, this placement rule affects the Canterbury rule previously described.

An optional rule that has not been tested is to restrict the move of the X to be B+forward K until it has moved off its initial square. This still guards the P in front of the A, but leaves the R unguarded, as in ordinary chess. Unlike ordinary chess, it also leaves the N unguarded. Once the X has moved, it acquires the full B+K movement capability. This rule has not been tested, but may bring a "traditional flavor" from ordinary chess into this game.

Special Moves (Including the new Canterbury Rule):

Movement rules are generally the same as in the 12×12 game, with the exceptions noted previously for the N and the A, and the stacked A/X combination. The Pawn move bonus and the en-passant rule are the same as in the 12×12 game. Castling rules are like the 10×10 game, E bonus moves and Back Rank moves are like the 10×10 game, and the J and L moves are like the 10×10 game, except the J entry square. The Canterbury rule is modified because of the A/X stacking rule, but the effect is still to facilitate Castling and help develop the X. In the 10×10 and 12×12 game the Canterbury move puts the Archbishop on the same diagonal as the B on the same side of the board and gets the X out of the way to prepare Castling. The same thing happens in the 10×10 scalable game, but the mechanism is slightly different because there is no G in the way, and no rank behind the rank the X starts on. The Canterbury can only occur if the X has not moved, but the A has moved so that the X is the only piece occupying its initial placement square. Furthermore, all the squares between the K and X on the K side must be vacant for the K-side Canterbury, and similarly all the squares between the Q and the X must be vacant for the Q-side Canterbury. Note that for K-side Canterbury, the K can not have moved, and for Q-side Canterbury, the Q can not have previously moved. Finally, the Canterbury can not be used to get out of check.

If all of the above conditions are met, a player may elect to make the Canterbury move. The Canterbury move is as follows: the X moves two squares towards the middle of the board along the Back Rank (an otherwise illegal move for the X) which places it on the square the B occupied in the initial setup. The X is still blocking Castling, so now the X is allowed to make 1 legal non capturing move from its new position on the B diagonal. For White, K-side Canterbury puts the X on the square g1 from where it makes a legal non capturing X move. For example: the X could now go to b6 if b6 is vacant. This is all one turn or move. For White Q-side Canterbury, the X would slide to d1, and then make a legal non capturing X move. The analogous squares for Black are: K-side Canterbury, g10, and for Q side Canterbury, d10. To record the Canterbury move, one can still use %-% for K side, and %-%-% for Q side Canterbury, but now the last part of the move must be added. Thus, it may be written for White's 9th move: 9%-% &Xd4, to indicate K-side Canterbury, with the X ending up on d4, or 9%-%-% &Xg4, for Q side Canterbury, with the X ending up on g4. When the X moves off the Back Rank, it must not be a capturing move, and it cannot be used to get out of check.

Javelin Entry

In the 10×10 game and the 12×12 game, when the J enters the board by moving straight sideways onto the square it was rank-wise adjacent to when it was off the board, it immediately attacks the P in front of the K Bishop. In the scalable game, the Pawn Start Rank (PSR) is moved back one rank compared to the 10×10 game. To preserve the attack feature of the J as in the other games, the J entry square is not to move one square sideways (on the same rank), but to move 1 square diagonally forward. Thus for White, the J entry squares are a6 and j6 rather than a5 and j5. Similarly for Black the J entry squares are a5 and j5.

It is to be understood by those having ordinary skill in the art that the chess variant discussed herein may be implemented in computer software. Specifically, the computer software embodying the chess variant described herein may operate on a personal computer, a personal data assistant, or any other suitable computing device. Furthermore, it is envisioned that the present invention may be operated in the context of a network, such as the Internet.

The above invention has been described with reference to the preferred and alternative embodiments. Obvious modifications, combinations, and alterations will occur to others upon reading the preceding detailed description. It is intended that the invention be construed as including all such modifications, combinations, and alterations insofar as they come within the scope of the appended claims or the equivalents thereof.

The invention claimed is:

1. A method of playing a variant chess game by a first player against a second player, comprising the steps of:

(a) providing a game board comprised of at least eight horizontal rows and at least eight vertical columns of squares having alternating light and dark squares forming a checkerboard pattern;

(b) providing a first set and a second set of conventional pieces for the first and second player, respectively, wherein each set of conventional pieces includes one King, one Queen, a first and second Rook, a first and second Bishop, a first and second Knight, and eight Pawns;

(c) positioning the first and second set of conventional pieces on the squares of the board in spaced-apart mirrored relation with respect to each other;

(d) providing a first set and a second set of non-conventional pieces for the first and second player, respectively, wherein each set of non-conventional pieces includes at least: an Angel, a Cardinal, a Minister, and a first and second Guard;

(e) positioning the Angel off the board;

(f) positioning the first Guard off the board and adjacent to a square occupied by the King of the first player;

(g) positioning the second Guard off the board and adjacent to a square occupied by the Queen of the first player;

(h) positioning the Cardinal off the board and adjacent to a square occupied by the first Bishop of the first player;

(i) positioning the Minister off the board and adjacent to a square occupied by the second Bishop of the first player;

(j) formatting rules of movement for play, wherein:

the Angel can only move on the game board in a movement corresponding to that of the Queen and the Knight of the conventional pieces, and wherein the Angel enters the board by moving to the square initially occupied by the first or second Rook;

the Cardinal can only move on the game board in a movement corresponding to that of the Bishop and the Knight of the conventional pieces, and wherein the Cardinal enters the board by moving to the square initially occupied by the first Bishop;

the Minister can only move on the game board in a movement corresponding to that of the Rook and the Knight of the conventional pieces, and wherein the Minister enters the board by moving to the square initially occupied by the second Bishop;

the first and second Guards are promotable and can capture in a forward moving direction, and wherein the first and second Guards enter the board by moving to the square initially occupied by the King and Queen, respectively;

(k) moving one of the conventional or non-conventional pieces of the first player through a square occupied by one of the Guards of the first player; and (l) preventing movement of one of the conventional or non-conventional pieces of the second player through a square occupied by one of the Guards of the first player.

2. The method of claim 1, wherein the game board includes at least ten horizontal rows and at least ten vertical columns of squares having alternating light and dark squares forming a checkerboard pattern.

* * * * *